US010220530B2

(12) United States Patent
Wang et al.

(10) Patent No.: US 10,220,530 B2
(45) Date of Patent: Mar. 5, 2019

(54) ELECTRIC SHAVER

(71) Applicant: Panasonic Intellectual Property Management Co., Ltd., Osaka (JP)

(72) Inventors: Wei Wang, Shiga (JP); Kotaro Yanagi, Shiga (JP); Satoshi Sobagaki, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 27 days.

(21) Appl. No.: 15/423,828

(22) Filed: Feb. 3, 2017

(65) Prior Publication Data

US 2017/0225342 A1 Aug. 10, 2017

(30) Foreign Application Priority Data

Feb. 9, 2016 (JP) ..... 2016-022464

(51) Int. Cl.
*B26B 19/06* (2006.01)
*B26B 19/28* (2006.01)
*B26B 19/38* (2006.01)

(52) U.S. Cl.
CPC ..... *B26B 19/063* (2013.01); *B26B 19/28* (2013.01); *B26B 19/386* (2013.01)

(58) Field of Classification Search
CPC ..... B26B 19/063; B26B 19/28; B26B 19/386; B26B 19/046; B26B 19/388; B26B 19/048; B26B 19/8846; B26B 19/3873; B26B 19/382; B26B 19/16; Y10T 83/04
USPC ..... 30/45, 34.1, 43, 34.05, 541, 43.6, 50, 30/526, 537
See application file for complete search history.

(56) References Cited

U.S. PATENT DOCUMENTS 2,749,613 A * 6/1956 Miller ..... B26B 19/42 30/34.2
2,880,503 A 4/1959 Carissimi
3,181,237 A * 5/1965 Jepson ..... B26B 19/42 30/34.2
5,152,064 A * 10/1992 Johnston ..... B26B 21/225 132/200

(Continued)

FOREIGN PATENT DOCUMENTS

EP 1930135 A1 6/2008
JP 2009-232894 A 10/2009
WO 1999/006190 A1 2/1999

OTHER PUBLICATIONS

The Extended European Search Report dated Jun. 20, 2017 for the related European Patent Application No. 17154724.3.

*Primary Examiner* — Ghassem Alie
(74) *Attorney, Agent, or Firm* — McDermott Will & Emery LLP

(57) ABSTRACT

An electric shaver includes a main body, an outer blade that is held by the main body in a state where a surface of the outer blade is exposed, an inner blade that is disposed inside the outer blade so as to be movable relative to the outer blade, and a rotator that has a rotating body disposed in the main body so as to extend in a moving direction of the inner blade, and a supporter disposed in the main body so as to rotatably support the rotating body. The rotator has an elastic body which enables the rotating body to rotate in a state where the rotating body is in contact with a skin, and which restrains the rotating body from vibrating in a state where the rotating body is not in contact with the skin.

12 Claims, 30 Drawing Sheets

(56) References Cited

U.S. PATENT DOCUMENTS 8,307,552 B1 * 11/2012 Drouillard ..... B26B 21/40
30/32

* cited by examiner

ELECTRIC SHAVER

RELATED APPLICATIONS

This application is claims the benefit of Japanese Application No. 2016-022464, filed on Feb. 9, 2016, the disclosure of which is incorporated by reference herein.

BACKGROUND

1. Technical Field

The present disclosure relates to an electric shaver.

2. Description of the Related Art

In the related art, an electric shaver is known which includes a shaver body, an outer blade supported by the shaver body, and an inner blade disposed inside the outer blade so as to be movable relative to the outer blade (for example, refer to Japanese Patent Unexamined Publication No. 2009-232894).

According to Japanese Patent Unexamined Publication No. 2009-232894, a roller is disposed in the shaver body so as to be rotatable via a roller support bracket. When the outer blade is moved along a skin, the roller rotates while coming into contact with the skin, thereby reducing a frictional force generated between the outer blade and the skin. Therefore, the hair can be more comfortably and more effectively shaved.

According to this technique in the related art, in order to smoothly rotate roller, a clearance is provided between the roller and the roller support bracket for supporting the roller so as to be rotatable. Therefore, when the electric shaver is driven, there is a possibility that the roller may vibrate and generate an abnormal sound.

SUMMARY

The present disclosure aims to provide an electric shaver which can restrain an abnormal sound caused by vibrations of a roller.

An electric shaver according to the present disclosure includes a main body, an outer blade that is held by the main body in a state where a surface of the outer blade is exposed, an inner blade that is disposed inside the outer blade so as to be movable relative to the outer blade, and a rotator that has a rotating body disposed in the main body so as to extend in a moving direction of the inner blade, and a supporter disposed in the main body so as to rotatably support the rotating body. The rotator of the electric shaver has an elastic body which enables the rotating body to rotate in a state where the rotating body is in contact with a skin, and which restrains the rotating body from vibrating in a state where the rotating body is not in contact with the skin.

According to this configuration, in a state where the rotating body is not in contact with the skin, the elastic body can restrain the rotating body from vibrating, and can restrain an abnormal sound from being generated.

On the other hand, the elastic body supports the rotating body so as to be rotatable in a state where the rotating body is in contact with the skin. Therefore, when the outer blade is moved along the skin, it is possible to reduce a frictional force generated between the outer blade and the skin due to the rotation of the rotating body.

In this way, according to the present disclosure, it is possible to obtain the electric shaver which can restrain the abnormal sound from being generated.

DETAILED DESCRIPTION

Figure 1A:
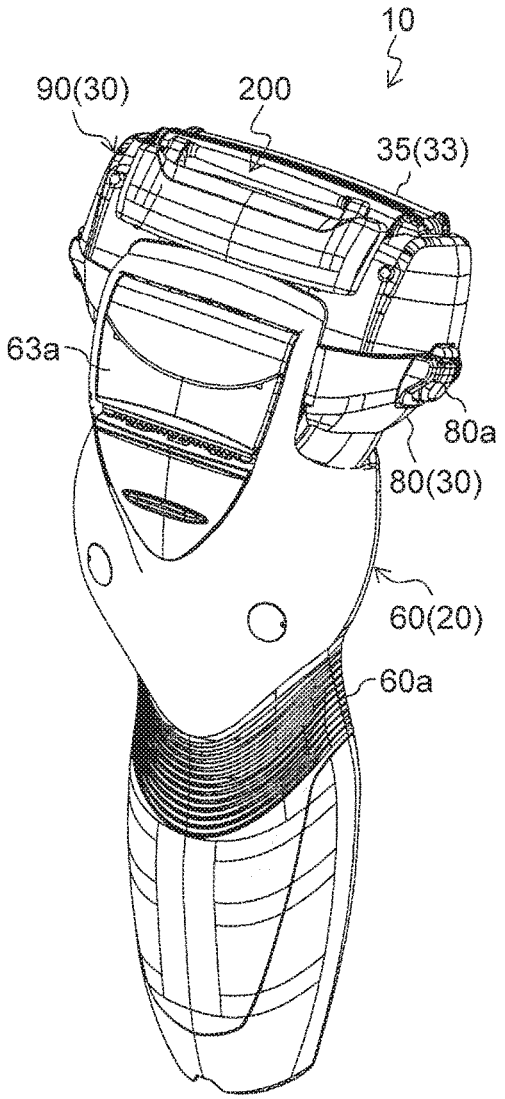
FIG. 1A is a perspective view illustrating a configuration of an electric shaver according to the exemplary embodiment of the present disclosure.
Figure 1B:
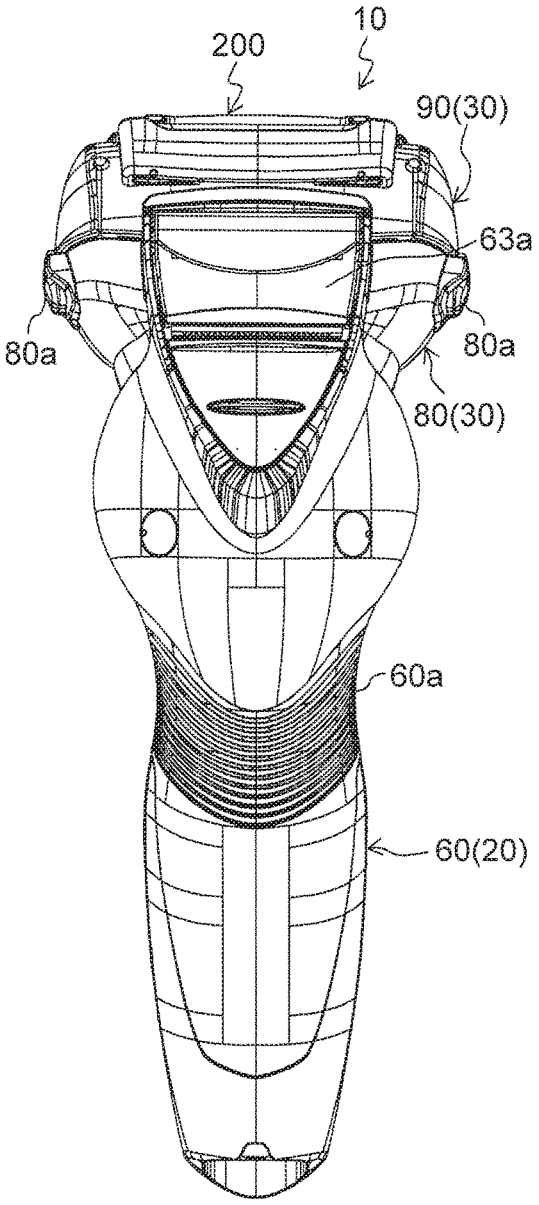
FIG. 1B is a rear view illustrating a configuration of the electric shaver according to the exemplary embodiment of the present disclosure.

An electric shaver according to an exemplary embodiment of the present disclosure includes a main body, an outer blade that is held by the main body in a state where a surface of the outer blade is exposed, and an inner blade that is disposed inside the outer blade so as to be movable relative to the outer blade.

Furthermore, the electric shaver includes a rotator that has a rotating body disposed in the main body so as to extend in a moving direction of the inner blade, and a supporter disposed in the main body so as to rotatably support the rotating body.

The rotator has an elastic body that enables the rotating body to rotate in a state where the rotating body is in contact with a skin, and that restrains the rotating body from vibrating in a state where the rotating body is not in contact with the skin.

According to this configuration, in a state where the rotating body is not in contact with the skin, the elastic body can restrain the rotating body from vibrating, and can restrain an abnormal sound from being generated.

On the other hand, the elastic body supports the rotating body so as to be rotatable in a state where the rotating body is in contact with the skin. Accordingly, when the outer blade is moved along the skin, it is possible to reduce a frictional force generated between the outer blade and the skin due to the rotation of the rotating body.

A configuration may be adopted as follows. The rotating body has a shaft in both ends in an extending direction of the rotating body. The supporter has a bearing into which the shaft is inserted. The elastic body is a spring that biases the shaft toward an inner surface of the bearing. The spring supports the rotating body so as to be floatable.

According to this configuration, the elastic body further has a function to bias the rotating body toward the supporter and a function to cause the rotating body to float to the main body. Therefore, the number of components can be reduced, and the configuration can be simplified.

A configuration may be adopted in which a load applied to the rotating body by the spring is 1 time to 30 times the self-weight of the rotating body.

According to this configuration, a force of the elastic body to support the rotating body is further ensured. It is possible to restrain a case where the rotating body becomes less likely to rotate due to an excessive frictional force applied to the rotating body.

A configuration may be adopted in which the outer blade is supported by the main body so as to be floatable, and in which a floating direction of the rotating body intersects a floating direction of the outer blade.

According to this configuration, a distance between the rotating body and the outer blade is further changed since a displacement height is changed. When the electric shaver is used, the skin can be stretched or squeezed by the rotating body and the outer blade.

A configuration may be adopted in which the main body has a curve which protrudes outward, and in which a displacement trajectory of the rotating body is curved along the curve of the main body.

According to this configuration, the main body having the rotator can be further miniaturized.

A configuration may be adopted in which the rotator is disposed outside the main body.

According to this configuration, even in a case where the electric shaver is used while the electric shaver touches the skin in a state where the main body of the electric shaver is tilted, a function of the rotator is fulfilled, thereby enabling a user to further feel more comfortable sensation in shaving.

A configuration may be adopted in which the electric shaver further includes a rotator unit that has the rotator and a rotator case which holds the rotator, and in which the rotator unit is disposed in the main body via the rotator case.

According to this configuration, the rotator is further integrally held by the rotator case. Therefore, while rigidity can be ensured, a size of the electric shaver can be reduced.

A configuration may be adopted in which the rotator unit is mounted on the main body so as to be detachable from the main body.

According to this configuration, for example, the electric shaver is used in a state where the rotator is not disposed in the main body. In this manner, the hair can be more reliably deeply shaved.

Since the electric shaver is used in a state where the rotator is disposed in the main body, it is possible to reduce a frictional force generated between the outer blade and the skin.

That is, a use state of the electric shaver can be diversified.

A configuration may be adopted in which the inner blade is disposed so as to be capable of linear reciprocating motion, in which the rotator extends in a reciprocating direction of the inner blade, and is disposed so as to be floatable to the main body, and in which a length of the ex tending direction of the rotator is greater than a reciprocating range of the inner blade.

Furthermore, the rotator also functions as a floater to float to the main body. A width in a reciprocating direction of the inner blade in a contact-available region where the floater can come into contact with the skin may be equal to or wider than a width in the reciprocating direction of the inner blade in a reciprocating region of the inner blade, or may be equal to or narrower than a width in the reciprocating direction of the inner blade in the main body.

Furthermore, a configuration may be adopted in which one side end in the reciprocating direction of the inner blade in the contact-available region is positioned outside in the reciprocating direction of the inner blade, compared to one side end in the reciprocating direction of the inner blade in the reciprocating region of the inner blade.

A configuration may be adopted in which the other side end in the reciprocating direction of the inner blade in the contact-available region is positioned outside in the reciprocating direction of the inner blade, compared to the other side end in the reciprocating direction of the inner blade in the reciprocating region of the inner blade.

According to this configuration, while the rotator is further restrained from increasing in size, the rotator can more reliably disperse a pressing force applied to the skin which is generated by the linear reciprocating motion of the inner blade, and a frictional force applied to the skin.

A configuration may be adopted in which the rotating body has a circular cross-sectional shape and a diameter in a thickest portion of the rotating body is at least 1.8 mm and at most 2.9 mm.

According to this configuration, when the electric shaver is used, while a function of the rotator can be further fulfilled, discomfort caused by the rotating body coming into contact with the skin can be alleviated. Therefore, it is possible to obtain more comfortable sensation in shaving.

A configuration may be adopted in which the rotator is disposed so as to be floatable to the main body, and in which a height of a top at a top dead center of the rotator becomes lower than a height of a top of the outer blade, and becomes higher than a height of a top of the main body.

The height of the top at a bottom dead center of the rotator may become lower than the height of the top of the main body.

In this manner, while the electric shaver can be restrained from having poor shaving performance, it is possible to obtain more comfortable sensation in shaving.

A configuration may be adopted in which the top of the rotating body has an utmost top whose height becomes highest, and in which the utmost top becomes higher than the top in both ends of the rotating body and becomes higher than the top of the supporter.

A configuration may be adopted in which the top in both ends of the rotating body becomes lower than the top of the supporter.

According to this configuration, while the rotating body can be more reliably brought into contact with the skin, discomfort caused by the rotating body coming into contact with the skin can be alleviated. Therefore, it is possible to obtain more comfortable sensation in shaving.

A configuration may be adopted in which the rotating body is supported in the supporter by a plurality of the elastic bodies which are elastically deformable independently of each other.

According to this configuration, the rotating body can be further more reliably brought into contact with the skin having various irregular shapes. Therefore, it is possible to obtain more comfortable sensation in shaving.

Hereinafter, an embodiment according to the present disclosure will be described with reference to the drawings.

The embodiment does not limit the present disclosure.

Hereinafter, description will be made in the following settings. A direction in which a plurality of outer blades are arrayed parallel to each other is referred to as front-back direction (shaving direction) X, a direction in which the respective outer blades extend is referred to as lateral direction Y, and a vertical direction in a state where an outer blade block (head unit) is disposed so that the outer blades face upward is referred to as vertical direction Z.

A side on which a switch unit of the electric shaver is disposed is referred to as a front side in front-back direction X.

A direction of the rotating body unit will also be described by using front-back direction X, lateral direction Y, and vertical direction Z which are described above. That is, in a state where the rotating body unit is mounted on an outer blade holding member (shaver body), directions which are coincident with front-back direction X, lateral direction Y, and vertical direction Z of the outer blade block (head unit) are respectively defined as front-back direction X, lateral direction Y, and vertical direction Z of the rotating body unit.

Embodiment

As illustrated in FIG. 1A to FIG. 4, electric shaver 10 according to the present exemplary embodiment includes gripper 20 that has holder 60*a* held by a hand, and head unit 30 that has blade unit 33 and that is supported by gripper 20.

In the present exemplary embodiment, head unit 30 is swingable in lateral direction Y with respect to gripper 20, around an axis of shaft 40 extending in front-back direction X.

That is, head unit 30 is supported by gripper 20 so as to be swingable around shaft 40.

Figure 4:
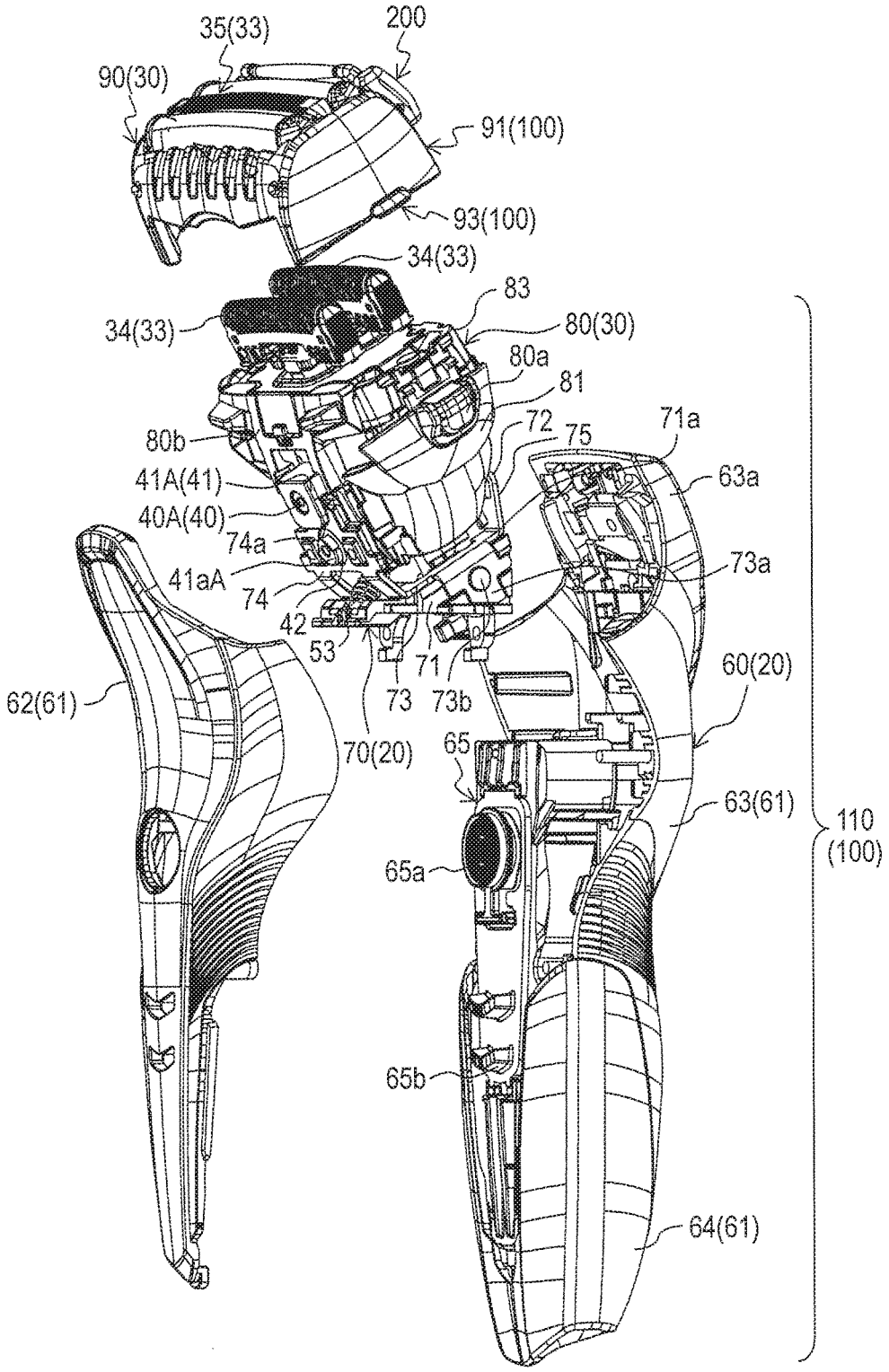
FIG. 4 is a perspective exploded view illustrating a configuration of the electric shaver according to the exemplary embodiment of the present disclosure.

As illustrated in FIG. 4, gripper 20 includes grip body 60 that has holder 60*a*, and base 70 that is fixed to one end side (upper side in vertical direction Z) of grip body 60 and that supports head unit 30.

Grip body 60 includes main body housing 61 formed of a synthetic resin. Main body housing 61 is formed by joining a plurality of divided bodies with each other. A cavity is formed inside main body housing 61 formed by joining the divided bodies with each other. The cavity internally accommodates various electrical components.

For example, the plurality of divided bodies can be joined with each other by using screws or by fitting the divided bodies to each other.

In the present exemplary embodiment, main body housing 61 is formed by joining the divided bodies such as front housing 62, rear housing 63, and lower housing 64 with each other. A cavity formed between front housing 62 and rear housing 63 accommodates power supply device (electrical component) 65 configured to include rechargeable battery 65*c* and control board 65*d* (refer to FIGS. 3 and 4).

Main body housing 61 has pressing-type switch unit 65*a* which operates (turns on or off a power source of) electric shaver 10. In the present exemplary embodiment, pressing-type switch unit 65*a* is described as an example of the switch unit. However, as long as the power source can be turned on or off by the switch, a sliding-type switch or other switches may be used.

In the present exemplary embodiment, switch unit 65*a* is formed on a front surface of front housing 62, that is, on a front surface (front face) of electric shaver 10. The front surface of electric shaver 10 means a surface on a side facing a user in a state where the user holds holder 60*a* of electric shaver 10 when the user normally uses electric shaver 10.

Furthermore, the present exemplary embodiment adopts a configuration in which a display 65*b* for displaying a charging state of rechargeable battery 65*c* incorporated in main body housing 61 is disposed in a lower portion of switch unit 65*a* in front housing 62.

Trimmer unit 63*a* is disposed in a rear portion of rear housing 63, that is, in a rear portion of electric shaver 10. A configuration without including trimmer unit 63*a* can also be adopted.

Blade unit 33 includes outer blade 35 and inner blade 34 disposed inside outer blade 35 (lower side of outer blade 35).

Outer blade 35 is disposed so as to be exposed upward from head unit 30. The exposed portion of outer blade 35 serves as contact surface (surface) 35*d* which comes into contact with skin S of a user.

The user turns on the power source of electric shaver 10. In a state where inner blade 34 is moved relative to outer blade 35 (reciprocating in lateral direction Y, contact surface 35*d* of outer blade 35 is moved while contact surface 35*d* is slid by touching skin S of the user. In this manner, inner blade 34 cuts hair introduced into a blade hole of outer blade 35.

Next, a specific configuration of head unit 30 and base 70 for supporting head unit 30 will be described.

As illustrated in FIG. 4, head unit 30 includes head unit body 80 mounted on base 70 (gripper 20), and outer blade block 90 mounted on head unit body 80 so as to be detachable therefrom.

Figure 3:
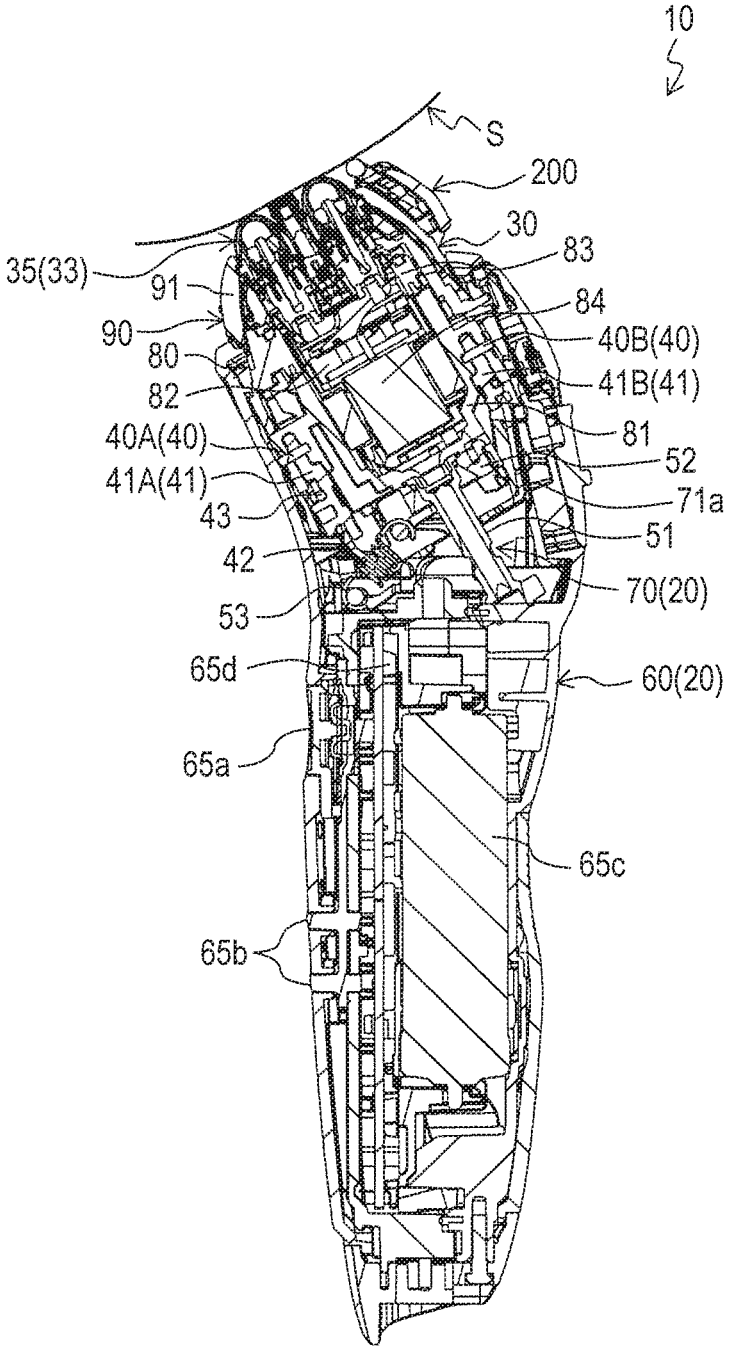
FIG. 3 is a sectional view taken along line 3-3 in FIG. 2A.

Head unit body 80 includes head case 81 that is open upward and that has drive mechanism accommodator 82 for accommodating drive mechanism 84, and head case cover 83 that covers the upward opening of head case 81 in a state where drive mechanism 84 is accommodated inside drive mechanism accommodator 82 (refer to FIGS. 3 and 4).

In the present exemplary embodiment, a vibration-type linear actuator is described as an example of drive mechanism 84. Without being limited to the vibration-type linear actuator, drive mechanism 84 may employ a known drive mechanism, for example, such as a drive mechanism configured to include a rotary motor and a conversion mechanism for converting a rotary motion into a linear reciprocating motion.

Drive mechanism accommodator 82 is caused to function as a waterproof space (sealed space). It is preferable to restrain water used when the hair shaved by blade unit 33 and inner blade 34 are cleaned from entering the inside drive mechanism accommodator 82.

On the other hand, as illustrated in FIG. 4, outer blade block 90 includes substantially cylindrical (including a cylinder) outer blade holding member 91 on which outer blade 35 is mounted so as to be vertically movable (floatable).

Figure 6:
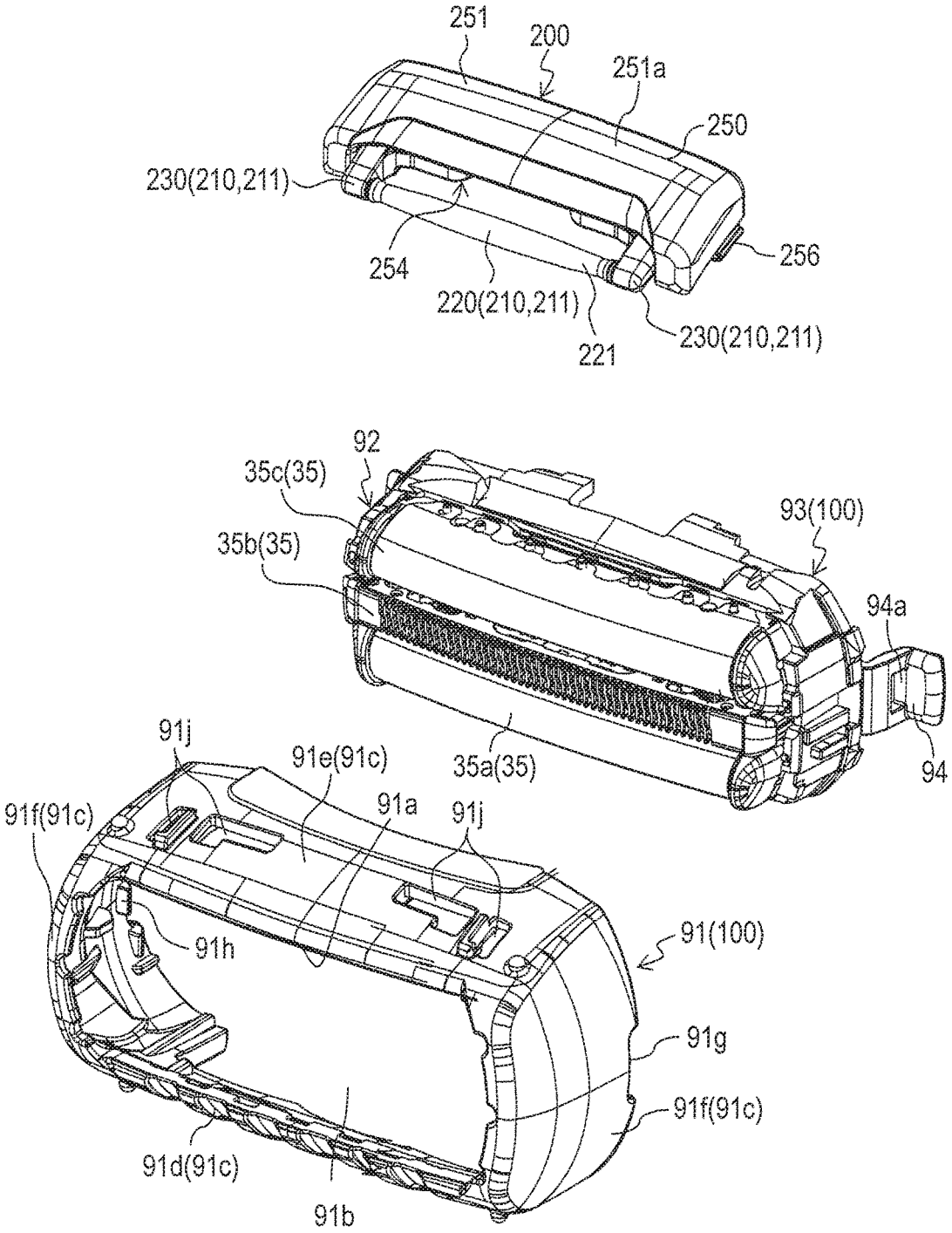
FIG. 6 is a perspective exploded view illustrating a configuration of the outer blade block according to the exemplary embodiment of the present disclosure.

Outer blade holding member 91 includes substantially cylindrical (including a cylinder) circumferential wall 91*c* on which upper opening 91*a* and lower opening 91*b* are formed (refer to FIG. 6).

In the present exemplary embodiment, circumferential wall 91*c* includes front wall 91*d* and rear wall 91*e* which extend in lateral direction Y and vertical direction Z (on plane YZ), and a pair of right and left side walls 91*f* and 91*f* which extends in front-back direction X and vertical direction Z (on plane XZ) and which are connected to front wall 91*d* and rear wall 91*e*. Box-shaped outer blade cassette 92 which supports outer blade 35 so as to be vertically movable is formed, and outer blade cassette 92 is mounted on outer blade holding member 91 by being accommodated therein from below. In this manner, outer blade 35 is mounted on outer blade holding member 91 so as to be vertically movable.

In the present exemplary embodiment, a plurality of outer blades 35 arrayed parallel to each other in front-back direction X are supported by outer blade cassette 92.

Specifically, outer blade 35 includes first net blade 35*a*, slit blade 35*b*, and second net blade 35*c*. First net blade 35*a*, slit blade 35*b*, and second net blade 35*c* are disposed parallel to each other in front-back direction X (refer to FIG. 6).

In the present exemplary embodiment, respective outer blades 35 (first net blade 35*a*, slit blade 35*b*, and second net blade 35*c*) are mounted on substantially frame-shaped outer blade frame 93 so as to be vertically movable independently of each other, thereby forming outer blade cassette 92.

Figure 5:
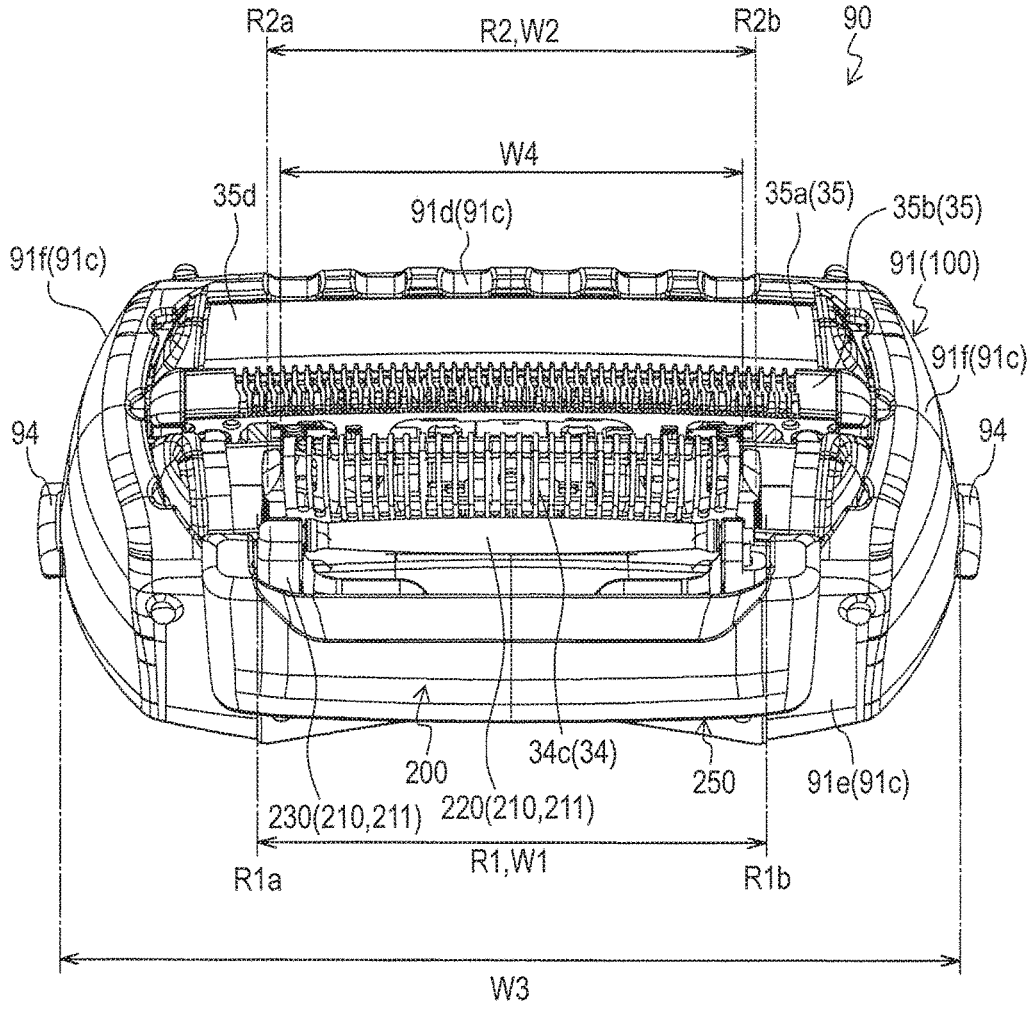
FIG. 5 is a perspective view illustrating a configuration of an outer blade block according to the exemplary embodiment of the present disclosure.
Figure 7:
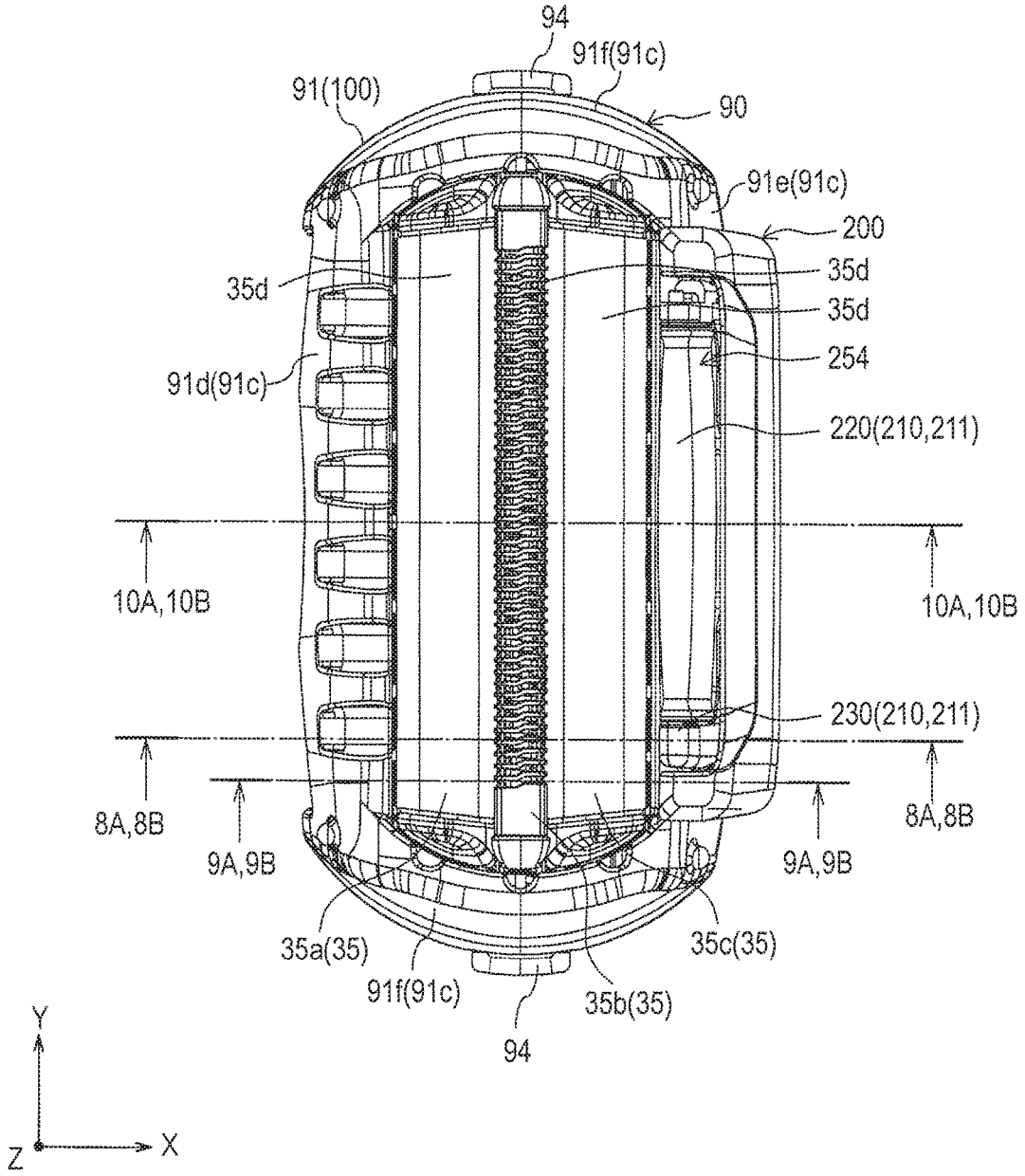
FIG. 7 is a plan view illustrating a configuration of the outer blade block according to the exemplary embodiment of the present disclosure.

As illustrated in FIGS. 5 to 7, both first net blade 35*a* and second net blade 35*c* are formed by being curved in an inverted U shape along front-back direction (short side direction) X so that the upper sides project in a side view (state where outer blade 35 is viewed in lateral direction Y). Furthermore, first net blade 35*a* and second net blade 35*c* are formed by being slightly curved along lateral direction (longitudinal direction) Y so that the upper sides project in a front view (state where outer blade 35 is viewed in front-back direction X).

In the present exemplary embodiment, first net blade 35*a* and second net blade 35*c* are curved so that the upper sides project in a front view. However, it is not always essential that first net blade 35*a* and second net blade 35*c* are curved.

Multiple blade holes (not illustrated) are formed in each of first net blade 35*a* and second net blade 35*c*.

As illustrated in FIGS. 8A to 10B, slit blade 35*b* is formed by being folded in front-back direction (short side direction) X. Multiple slits (blade holes) extending from an upper flat wall to a side wall are drilled.

That is, in slit blade 35*b*, multiple slits (blade holes) are formed while being divided by a crosspiece extending from the upper flat wall to the side wall and a crosspiece extending along longitudinal direction (lateral direction) Y in the lower portion of the side wall.

In the present exemplary embodiment, first net blade 35*a*, second net blade 35*c*, and slit blade 35*b* which configure outer blade 35 are respectively mounted on a dedicated outer blade frame, thereby forming outer blade units.

The outer blade units respectively engage with outer blade frames 93 so as to be vertically movable independently of each other, thereby forming outer blade cassette 92.

As illustrated in FIG. 6, elastic pieces 94 respectively extend downward in both right and left ends of outer blade frame 93. Through-holes 94*a* penetrating in the lateral direction are formed in a pair of right and left elastic pieces 94.

Recesses 91*g* and 91*g* are formed in lower edge of side walls 91*f* and 91*f* on both sides of substantially cylindrical outer blade holding member 91 in which both upper and lower ends are open, that is, in which upper opening 91*a* and lower opening 91*b* are formed. Hooks 91*h* and 91*h* projecting inward project in portions corresponding to respective recesses 91*g* and 91*g* of side walls 91*f* and 91*f* on both sides.

If outer blade cassette 92 is inserted into outer blade holding member 91 from lower opening 91*b* while elastic pieces 94 and 94 in both right and left ends of outer blade frame 93 pass through recesses 91*g* and 91*g*, hooks 91*h* and 91*h* projecting inward from outer blade holding member 91 engage with through-holes 94*a* and 94*a*. In this way, outer blade cassette 92 is mounted on outer blade holding member 91.

According to this configuration, sequentially from the front in front-back direction X, first net blade 35*a*, slit blade 35*b*, and second net blade 35*c* are disposed in outer blade holding member 91 so as to be exposed upward.

In the present exemplary embodiment, outer blade cassette 92 is mounted on outer blade holding member 91 so as to be detachable therefrom, and is also mounted on head unit body 80 so as to be detachable therefrom.

In inner blade 34, a dedicated inner blade is installed for first net blade 35*a*, second net blade 35*c*, and slit blade 35*b* which configure outer blade 35. Specifically, inverted U-shaped inner blades (first inner blade 34*a* and second inner blade 34*c*) which extend along respective curve shapes of first net blade 35*a* and second net blade 35*c* are disposed below (inside) first net blade 35*a* and second net blade 35*c* (refer to FIGS. 8A and 8B). Slit inner blade 34*b* extending along a folded shape of slit blade 35*b* is disposed below (inside) slit blade 35*b*.

Inner blades 34 are mounted on drive mechanism 84. If drive mechanism 84 is driven, inner blades 34 respectively reciprocate in lateral direction (longitudinal direction) Y.

First inner blade 34*a*, second inner blade 34*c*, and slit inner blade 34*b* are mounted on drive mechanism 84 so as to be vertically movable independently of each other. Respective inner blades 34 are disposed on the lower side of corresponding outer blade 35 so as to slide on the inner surface of outer blade 35 when inner blades 34 reciprocate in lateral direction (longitudinal direction) Y.

In this way, first inner blade 34*a*, second inner blade 34*c*, and slit inner blade 34*b* which are respectively disposed below (inside) first net blade 35*a*, second net blade 35*c*, and slit blade 35*b* are respectively moved relative to respective outer blades 35 (caused to reciprocate in lateral direction Y). In this manner, the hair introduced into the blade holes and slits of respective outer blades 35 can be cut by a plurality of outer blades 35 in cooperation with inner blades 34 respectively corresponding to the plurality of outer blades 35.

In the present exemplary embodiment, slit inner blade 34*b* is mounted on outer blade cassette 92 so as to be capable of reciprocating with respect to slit blade 35*b*.

Release button 80*a* (refer to FIGS. 2A and 2B) is disposed in both right and left ends of head unit body 80 so as to be capable of projecting in lateral direction Y. Release button 80*a* is pressed inward, thereby releasing outer blade block 90 mounted on head unit body 80.

When outer blade block 90 is mounted on head unit body 80, a space which can collect the hair shaved by blade unit 33 is formed in an upper portion of head case cover 83.

Figure 2A:
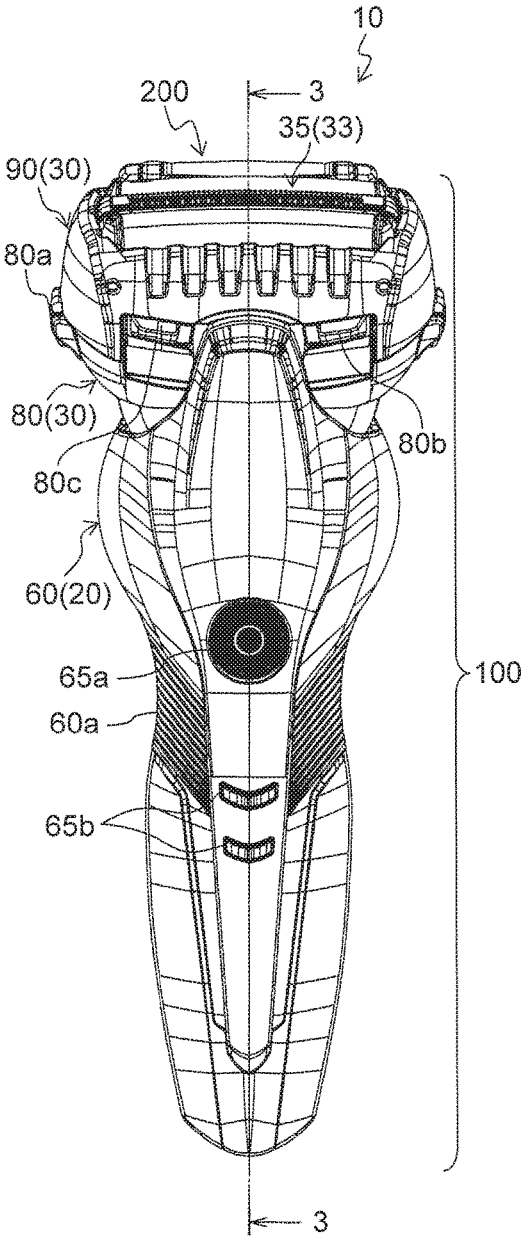
FIG. 2A is a front view illustrating a configuration of the electric shaver according to the exemplary embodiment of the present disclosure.
Figure 2B:
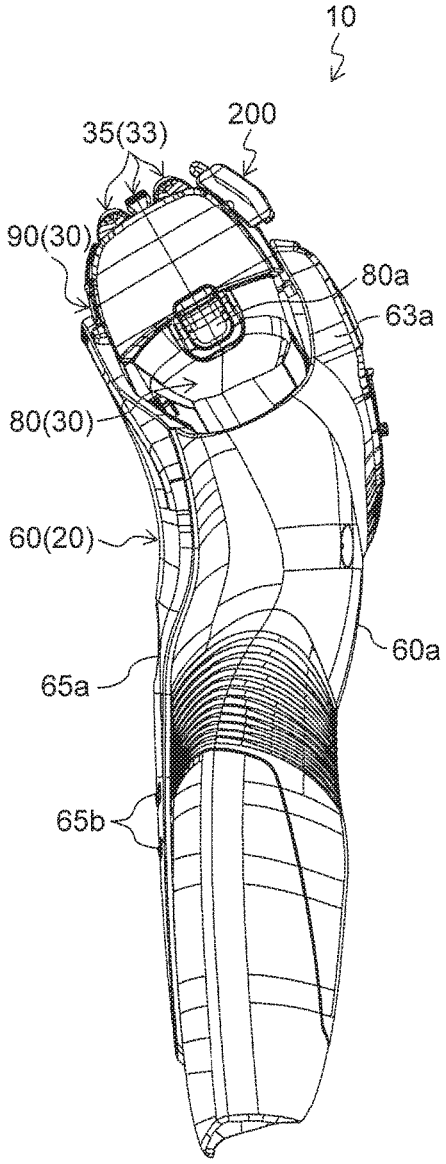
FIG. 2B is a side view illustrating a configuration of the electric shaver according to the exemplary embodiment of the present disclosure.

Window 80*c* through which the space communicates with an external space is formed in a front portion of head unit 30 (refer to FIG. 2A). Window 80*c* functions as an introduction port for introducing water into the space when the hair collected in the space is cleaned, and as a discharge port for discharging the hair and the water inside the space.

A shutter (lid) 80*b* which covers window 80*c* so as to be openable or closeable is disposed in the front portion of head unit 30 so as to be slidable in the vertical direction.

In the present exemplary embodiment, as illustrated in FIGS. 3 and 4, gripper 20 and head unit 30 are connected to each other via connection member 41.

That is, one end (lower side) of connection member 41 is connected to gripper 20, and the other end (upper side) is connected to head unit 30.

In this case, a configuration is adopted in which connection member 41 moves relative to gripper 20 in an intersecting direction (direction along plane YZ) intersecting the extending direction (front-back direction X) of shaft 40.

Connection member 41 is connected to head unit 30 via shaft 40. Head unit 30 laterally swings with respect to connection member 41 around shaft 40.

In the present exemplary embodiment, connection member 41 is connected to holder member 72 of base 70 configuring a portion of gripper 20, and is also connected to head case 81 configuring a portion of head unit 30 (refer to FIGS. 5 to 8B).

Furthermore, connection member 41 includes front connection member 41A and rear connection member 41B formed separate from front connection member 41A. Front connection member 41A and rear connection member 41B are respectively connected to holder member 72 (gripper 20) and head case 81 (head unit 30).

In the present exemplary embodiment, shaft 40 formed separate from head unit 30 and connection member 41 is used. Shaft 40 includes front shaft 40A and rear shaft 40B formed separate from front shaft 40A.

Front connection member 41A is connected to a front portion of head case 81 (head unit 30) via front shaft 40A, and rear connection member 41B is connected to a rear portion of head case 81 (head unit 30) via rear shaft 40B (refer to FIG. 3).

Base 70 includes base body 71 fixed to one end side (upper side in vertical direction Z) of grip body 60, and holder member 72 which is mounted on base body 71 and to which connection member 41 (front connection member 41A and rear connection member 41B) is connected.

Base body 71 is mounted on grip body 60. In a state where the longitudinal direction of grip body 60 is positioned to be the vertical direction, when viewed in lateral direction Y, base body 71 has a triangular shape in which the upper portion of base body 71 serves as a tilting piece tilting forward and downward. Holder member 72 is mounted on the upper portion of base body 71, that is, on tilting surface 71*a* tilting forward and downward (refer to FIG. 4).

In the present exemplary embodiment, a direction perpendicular to tilting surface 71*a* is coincident with vertical direction Z which is the vertical direction of head unit 30. Therefore, in the present exemplary embodiment, head unit 30 is mounted on grip body 60 so that the upper portion of head unit 30 tilts forward and downward when viewed in lateral direction Y, in a state where the longitudinal direction of grip body 60 becomes the vertical direction (refer to FIG. 2B).

Holder member 72 includes loader 73 loaded on tilting surface 71*a* of base body 71. Mounting pieces 73*a* extending downward and rearward are respectively formed in both ends in lateral direction Y of loader 73.

Right and left mounting pieces 73*a* are fixed to base body 71 by screws 73*b*, thereby mounting holder member 72 on base body 71 (refer to FIG. 4).

As illustrated in FIG. 4, holder member 72 includes front connection piece 74 which is connected to a front end of loader 73 and which extends forward and upward, and rear connection piece 75 which is connected to a rear end of loader 73 and which extends rearward and upward.

Front connection piece 74 and front connection member 41A are connected to each other, and rear connection piece 75 and rear connection member 41B are connected to each other (refer to FIG. 4).

Here, in the present exemplary embodiment, substantially cylindrical (including a cylinder) projection 41*a*A projecting forward is formed at a position shifted from front shaft 40A, which is immediately below front shaft 40A in front connection member 41A.

Substantially circular (including a circular shape) insertion hole 74*a* into which projection 41*a*A is inserted is formed in front connection piece 74.

An inner diameter of insertion hole 74*a* is configured to be larger than an outer diameter of projection 41*a*A. In this manner, in a state where connection member 41 (front connection member 41A) is connected to gripper 20 (holder member 72), when viewed in front-back direction X (extending direction of shaft 40), substantially annular (including an annular shape) clearance 42 which allows connection member 41 (front connection member 41A) to move relative to gripper 20 (holder member 72) in the intersecting direction (direction along plane YZ) is formed between connection member 41 (front connection member 41A) and gripper 20 (holder member 72).

O-ring (elastic member) 43 is disposed in substantially annular clearance 42. In this manner, connection member 41 (front connection member 41A) is connected to gripper 20 (holder member 72) via O-ring 43.

According to this configuration, while connection member 41 is allowed to move relative to gripper 20 in the intersecting direction, rattling of connection member 41 can be more reliably restrained.

According to the configuration, in a state where a central axis of front shaft 40A and a central axis of rear shaft 40B are positioned on a substantially straight line (including a straight line), head unit 30 is supported by gripper 20. Accordingly, head unit 30 is enabled to more smoothly swing with respect to gripper 20.

In the present exemplary embodiment, wiring tube 51 is fixed to a lower portion of head case 81 by wiring tube holding member 52. Wiring tube holding member 52 and base body 71 are connected to each other by tension spring 53. In this way, wiring tube holding member 52 and base body 71 are connected to each other by tension spring 53, thereby causing head unit 30 to return to a neutral position.

Electric shaver 10 includes shaver body (main body) 100, outer blade 35 held by shaver body 100 in a state where contact surface (surface) 35*d* is exposed, and inner blade 34 disposed inside outer blade 35 so as to be movable relative to outer blade 35.

In the present exemplary embodiment, among components configuring electric shaver 10, those which are configured to include gripper 20 and head unit 30 other than blade unit 33 serve as shaver body 100.

Shaver body 100 includes drive body 110 which drives mounted inner blade 34, and outer blade holding member 91 which holds outer blade 35 in a state where contact surface (surface) 35*d* is exposed.

Outer blade holding member 91 is mounted on drive body 110 so as to be detachable therefrom.

In the present exemplary embodiment, outer blade block 90 including outer blade holding member 91 is mounted on head unit body 80 so as to be detachable therefrom. Accordingly, among components configuring electric shaver 10, those which are configured to include components remaining by detaching outer blade block 90 and inner blade 34 serve as drive body 110.

Therefore, outer blade holding member 91 is mounted on drive body 110 so as to be detachable therefrom via outer blade frame 93 of outer blade cassette 92.

In this way, in the present exemplary embodiment, shaver body 100 includes drive body 110, outer blade holding member 91, and outer blade frame 93.

In the present exemplary embodiment, rotating body unit 200 is disposed in outer blade holding member 91 of shaver body 100. In this manner, when outer blade 35 is moved along skin S, rotating body 220 of rotating body unit 200 rotates while coming into contact with skin S.

According to this configuration, when outer blade 35 is moved along skin S, it is possible to reduce a frictional force generated between outer blade 35 and skin S. Therefore, the hair can be more comfortably and more effectively shaved.

Next, a specific configuration of rotating body unit 200 and a structure of mounting rotating body unit 200 on shaver body 100 will be described.

Rotating body unit 200 described above is one of components configuring electric shaver 10. However, hereinafter, an example will be described in which rotating body unit 200 does not configure shaver body 100.

That is, the above description of "among components configuring electric shaver 10, those which are configured to include gripper 20 and head unit 30 other than blade unit 33 serve as shaver body 100" means that among components configuring electric shaver 10, those which are configured to include gripper 20 and head unit 30 (however, blade unit 33 and rotating body unit 200 are excluded) configure shaver body 100.

Figure 12:
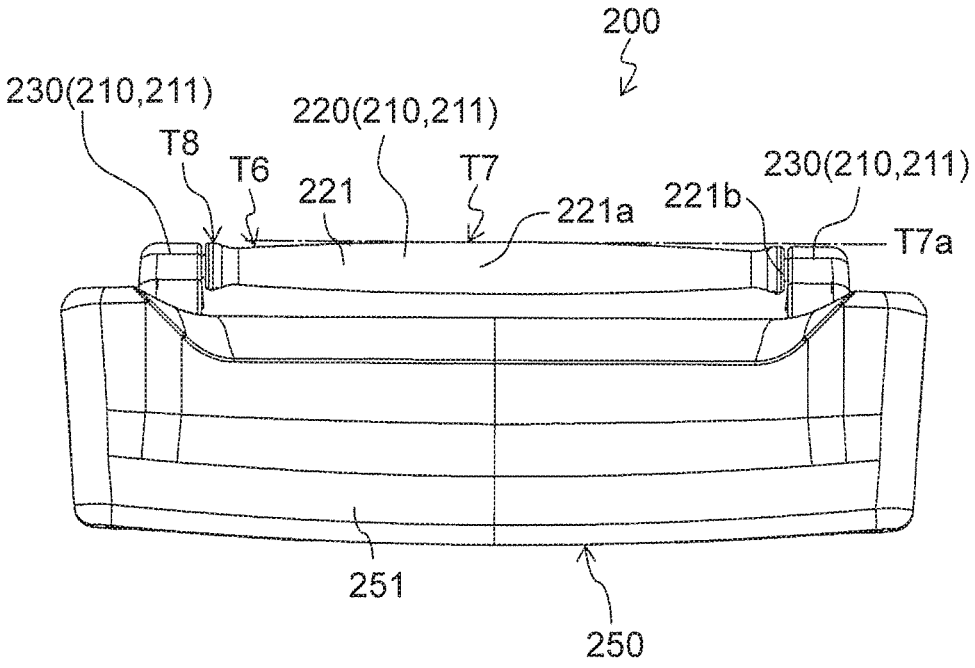
FIG. 12 is a view when a rotating body unit is viewed from outside according to the exemplary embodiment of the present disclosure.

As illustrated in FIG. 12, rotating body unit 200 according to the present exemplary embodiment is formed in such a way that rotator case 250 holds rotator 210 formed by supporter 230 supporting rotating body 220 so as to be rotatable.

That is, rotating body unit 200 includes rotator 210 and rotator case 250 which integrally holds rotator 210.

Rotator 210 has rotating body 220 mounted on shaver body 100 so as to be rotatable, and supporter 230 which supports rotating body 220 so as to be rotatable.

Figure 14:
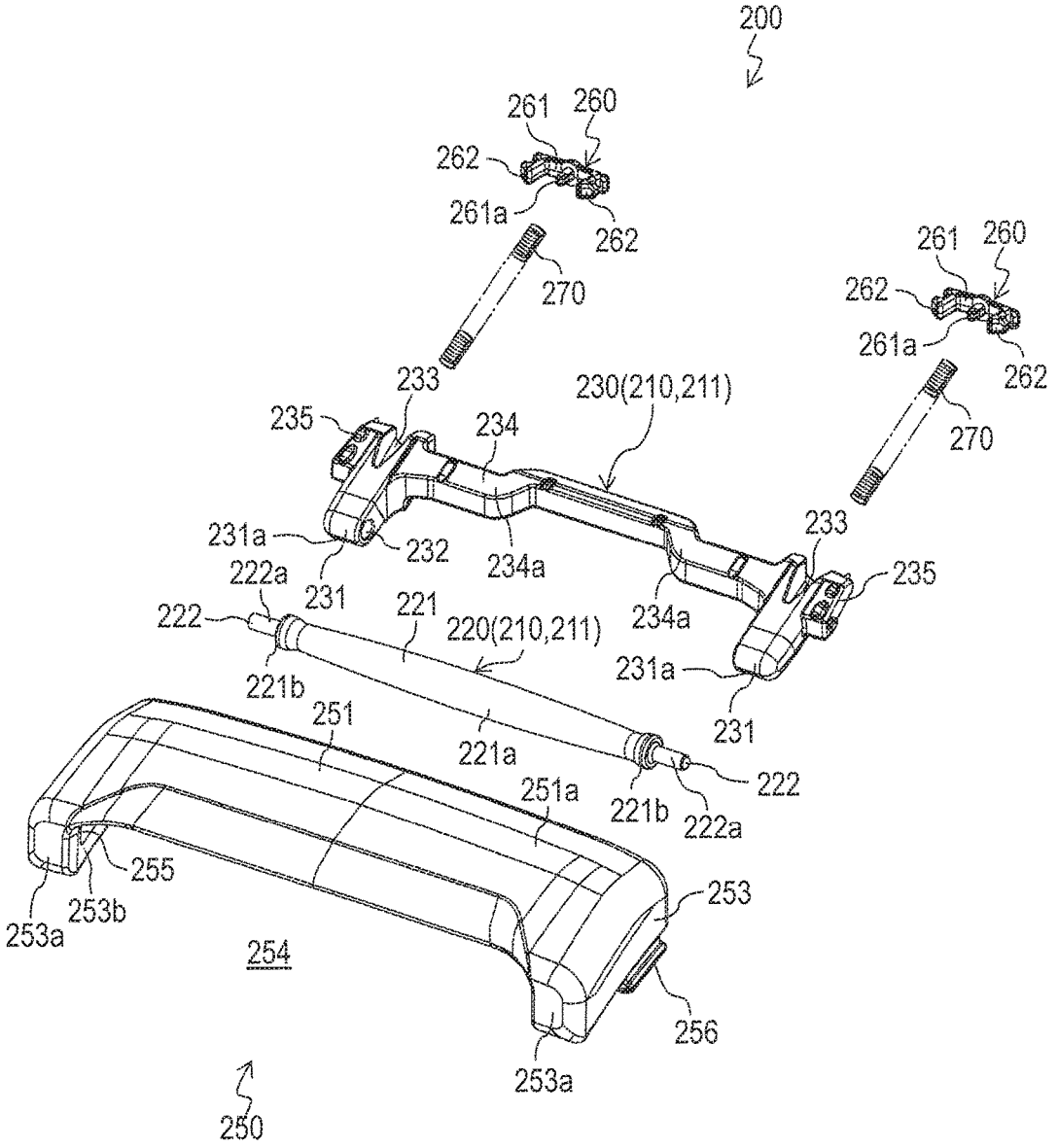
FIG. 14 is a perspective exploded view illustrating a configuration of the rotating body unit according to the exemplary embodiment of the present disclosure.
Figure 15A:
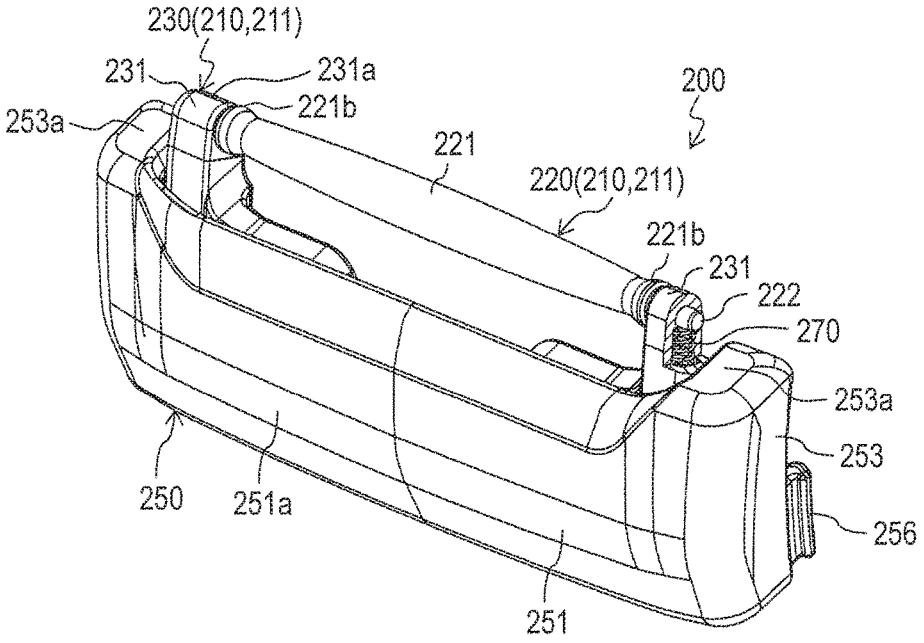
FIG. 15A is a perspective view illustrating the rotating body unit which is partially broken away according to the exemplary embodiment of the present disclosure.
Figure 15B:
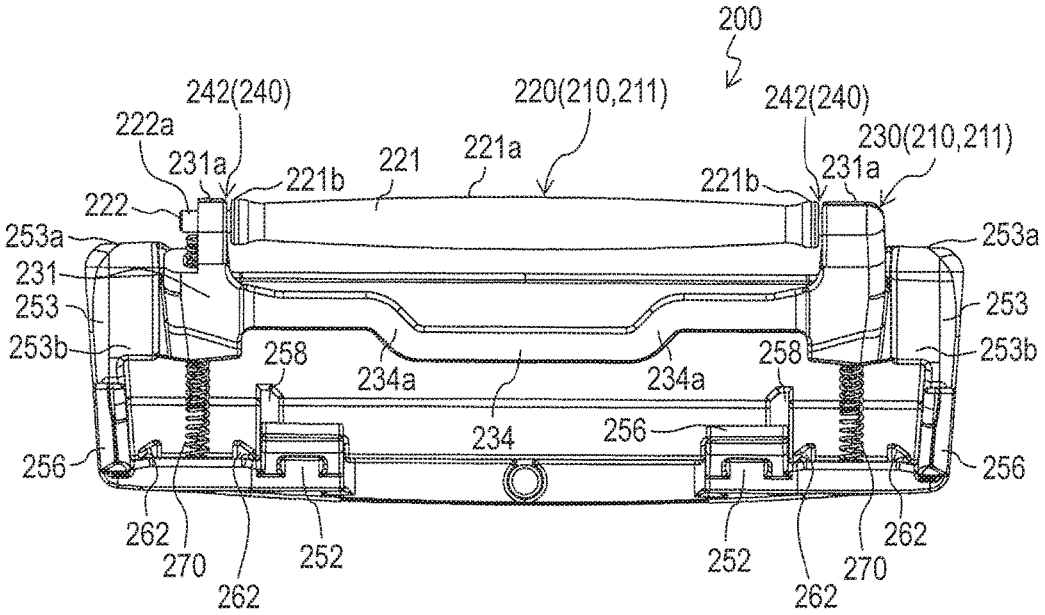
FIG. 15B is a view when the rotating body unit which is partially broken away is viewed from inside according to the exemplary embodiment of the present disclosure.
Figure 16:
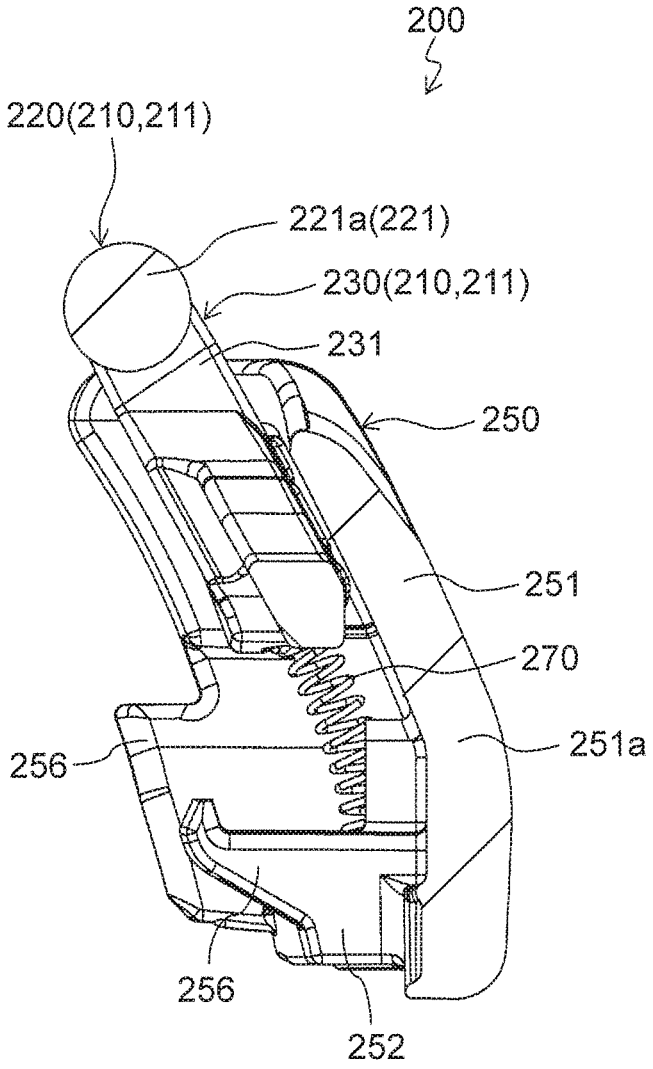
FIG. 16 is a sectional view taken along line 16-16 in FIG. 13.

As illustrated in FIG. 14, rotating body 220 includes main body 221 which extends in lateral direction Y and shafts 222 which project outward in lateral direction Y from each of both ends 221*b* and 221*b* of main body 221. It is preferable that rotating body 220 is formed of a material which is not easily deformed, such as resins, metal, and ceramics.

In the present exemplary embodiment, main body 221 has a substantially circular (including a circular shape) cross-sectional shape. An upper side ridge line in a front view (state where main body 221 is viewed in front-back direction X) configures top T6. Top T6 is formed by being curved along lateral direction (longitudinal direction of main body 221) Y so that the upper side projects in a front view (refer to FIG. 12).

That is, main body 221 is formed so that the diameter decreases from the center toward both ends in lateral direction Y. In the present exemplary embodiment, in both ends 221*b* and 221*b* of main body 221, the diameter increases outward in lateral direction Y. However, a height of top T6 in the center of main body 221 is configured to become higher than a height of top T6 in both ends 221*b* and 221*b* of main body 221.

In this way, in the present exemplary embodiment, main body 221 has thickest portion 221*a* in which a center in lateral direction Y is thickest (diameter is maximized). Top T6 in thickest portion 221*a* is utmost top T7 (refer to FIG. 12).

That is, top T6 of rotating body 220 has utmost top T7 whose height is highest at the center in lateral direction Y. Height T7*a* of utmost top T7 is higher than height T8*a* of top T8 in each of both ends 221*b* and 221*b* of rotating body 220 (refer to FIG. 19).

If the outer diameter of rotating body 220 is too large (for example, the diameter in thickest portion 221*a* is larger than 2.9 mm), there is a possibility that a user may feel discomfort on the skin when using electric shaver 10. On the other hand, if the outer diameter of rotating body 220 is too small (for example, the diameter in thickest portion 221*a* is smaller than 1.8 mm), rotating body 220 is less likely to rotate.

Therefore, when rotating body 220 is formed, it is preferable to adopt a configuration in which the diameter in thickest portion (thickest portion of rotating body 220) 221*a* is 1.8 mm to 2.9 mm.

As described above, rotating body 220 configured in this way is supported by support member (supporter) 230 so as to be rotatable.

As illustrated in FIG. 14, supporter 230 includes a pair of bearings 231 and 231 disposed on both sides in lateral direction Y, and connectors 234 connected to a lower end of the pair of bearings 231 and 231.

The pair of bearings 231 and 231 respectively have bearing holes 232 and 232 into which shafts 222 and 222 formed in both ends of rotating body 220 are inserted.

Bearing holes 232 and 232 are formed inside the pair of bearings 231 and 231 in lateral direction Y so as to face each other.

An opening diameter of the pair of bearings 231 and 231 is formed to be slightly larger than the diameter of shafts 222 and 222.

Figure 18:
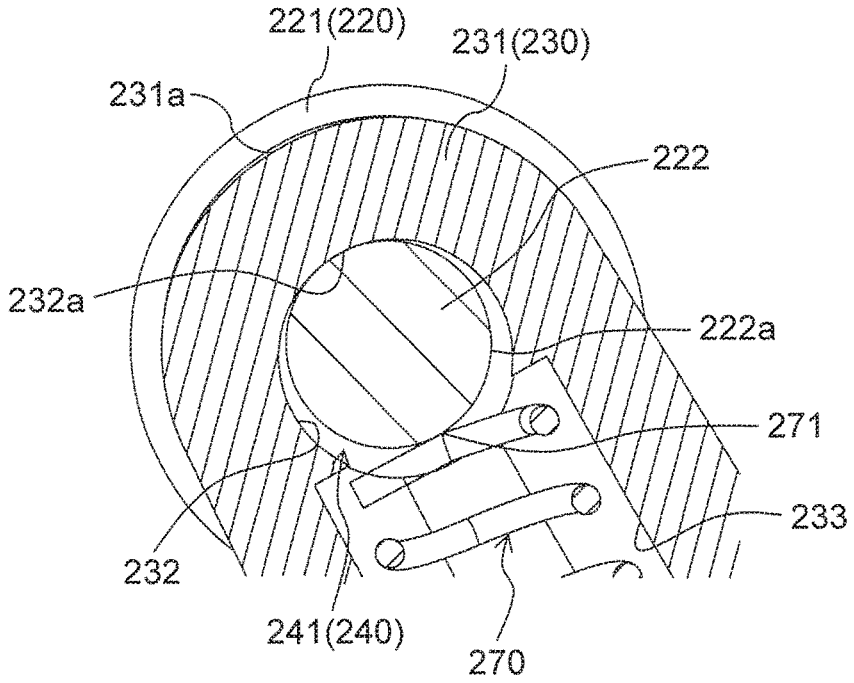
FIG. 18 is a view illustrating an enlarged G-portion in FIG. 17.

Therefore, in a state where rotating body 220 is supported by supporter 230 after respectively inserting right and left shafts 222 into the pair of bearing holes 232, clearance 241 is formed between circumferential surface 222*a* of shaft 222 and inner surface 232*a* of bearing hole 232 (refer to FIG. 18).

Figure 19:
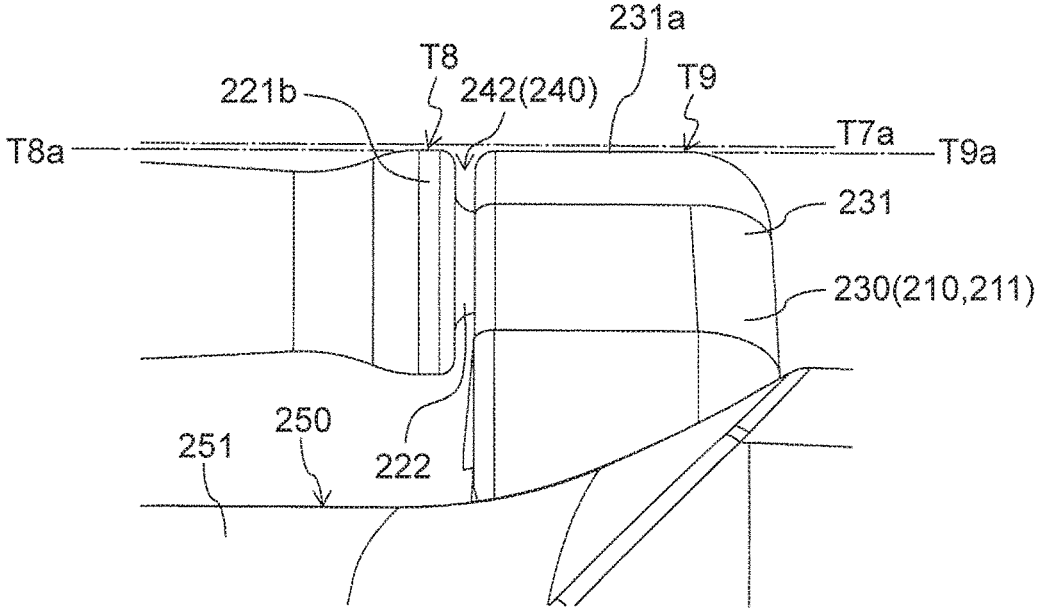
FIG. 19 is a view illustrating the vicinity of a shaft of the rotating body in the partially enlarged rotating body unit according to the exemplary embodiment of the present disclosure.
Figure 20:
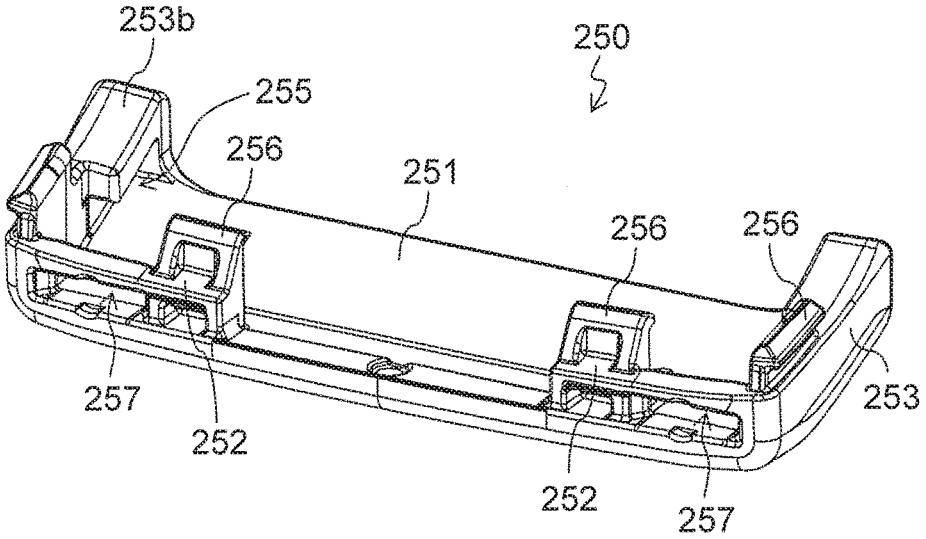
FIG. 20 is a perspective view illustrating a configuration of a rotator case according to the exemplary embodiment of the present disclosure.
Figure 21:
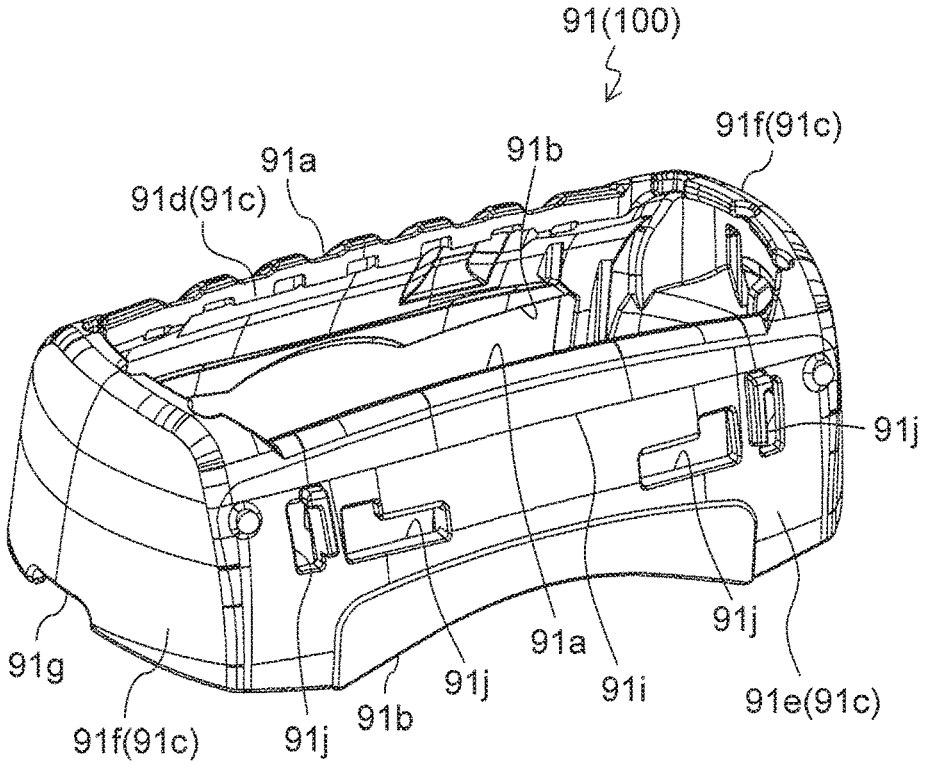
FIG. 21 is a perspective view illustrating a configuration of the outer blade holding member according to the exemplary embodiment of the present disclosure.
Figure 22:
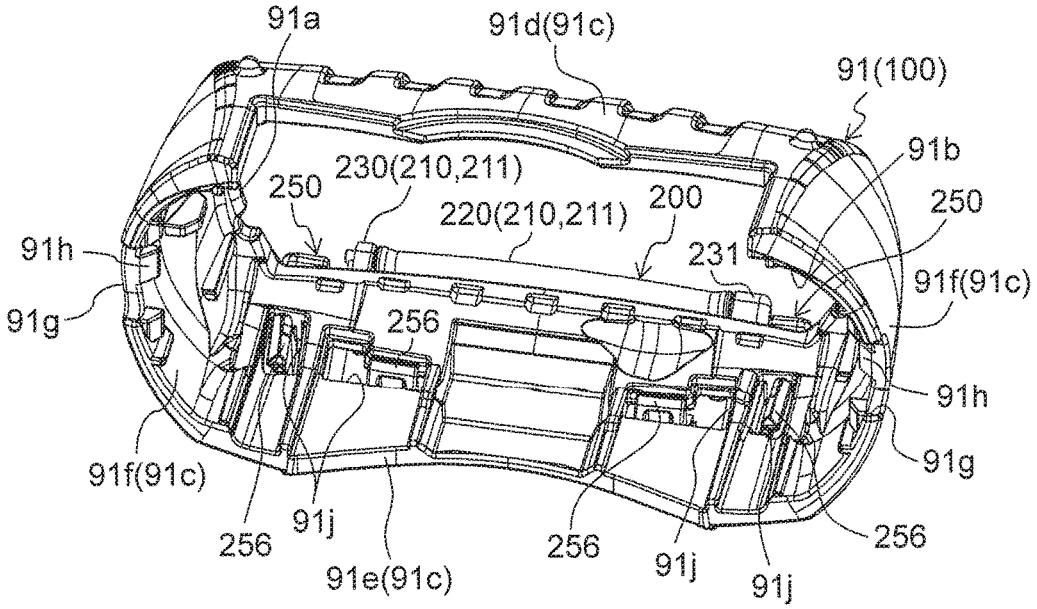
FIG. 22 is a perspective view illustrating a state where the rotating body unit is mounted on the outer blade holding member according to the exemplary embodiment of the present disclosure.

A configuration is adopted in which clearance 242 is also formed between main body 221 of rotating body 220 and bearings 231 and 231 of supporter 230 (refer to FIG. 19).

In this way, in the present exemplary embodiment, rotating body 220 is supported by supporter 230 in a state where clearance 240 (clearance 241 and clearance 242) is formed between rotating body 220 and supporter 230.

Since clearance 240 is formed, rotating body 220 smoothly rotates with respect to supporter 230.

In the present exemplary embodiment, curves 234*a* and 234*a* are formed in connector 234 so that connector 234 can be elastically deformed. Connector 234 is elastically deformed from curves 234*a* and 234*a* as a base point. In this manner, the pair of bearings 231 and 231 can be open outward in lateral direction Y.

In a state where the pair of bearings 231 and 231 is open outward in lateral direction Y, shafts 222 and 222 are inserted into bearing holes 232 and 232. In this manner, rotating body 220 can be mounted on supporter 230.

In a state where rotating body 220 is mounted on supporter 230, height T7*a* of utmost top T7 of rotating body 220 is configured to be higher than height T9*a* of top T9 of supporter 230. Height T8*a* of top T8 in both ends 221*b* and 221*b* of rotating body 220 is configured to be lower than height T9*a* of top T9 of supporter 230 (refer to FIG. 19).

In the present exemplary embodiment, upper end surfaces 231*a* and 231*a* of the pair of bearings 231 and 231 configure top T9 of supporter 230.

In this way, rotating body 220 is mounted on supporter 230 so as to be rotatable, thereby forming rotator 210.

Rotator 210 is held integrally with rotator case 250, thereby forming rotating body unit 200.

As illustrated in FIG. 14, rotator case 250 includes rear wall 251 which covers rotator 210 from rear when rotating body unit 200 is mounted on outer blade holding member 91 (shaver body 100). Bottom wall 252 is connected to a lower portion of rear wall 251 so as to extend forward. A pair of side walls 253 and 253 is connected to both ends in lateral direction Y of rear wall 251 so as to extend forward.

Accommodation space 254 which accommodates rotator 210 is formed by rear wall 251, bottom wall 252, and the pair of side walls 253 and 253.

Here, in the present exemplary embodiment, rotator 210 has floater 211 which floats to rotator case 250 (shaver body 100).

Specifically, an entire body of rotator 210 including rotating body 220 is configured to be supported by coil spring (elastic body) 270 so as to be floatable to rotator case 250, thereby forming floater 211.

In this way, in the present exemplary embodiment, the entire body of rotator 210 configures floater 211 which floats to rotator case 250 (shaver body 100). A configuration can also be adopted in which a portion of rotator 210 serves as floater 211.

Next, a structure will be described in detail in which rotator 210 floats to rotator case 250 (shaver body 100).

First, in the present exemplary embodiment, spring insertion holes 233 and 233 extending in substantially vertical direction Z are respectively formed in the pair of bearings 231 and 231 so as to communicate with bearing holes 232 and 232 (refer to FIG. 18).

A configuration is adopted in which coil springs (elastic bodies) 270 and 270 are inserted from below into respective spring insertion holes 233 and 233 so as to bring upper ends 271 and 271 of coil springs (elastic bodies) 270 and 270 into contact with circumferential surfaces 222*a* and 222*a* of shafts 222 and 222.

Figure 17:
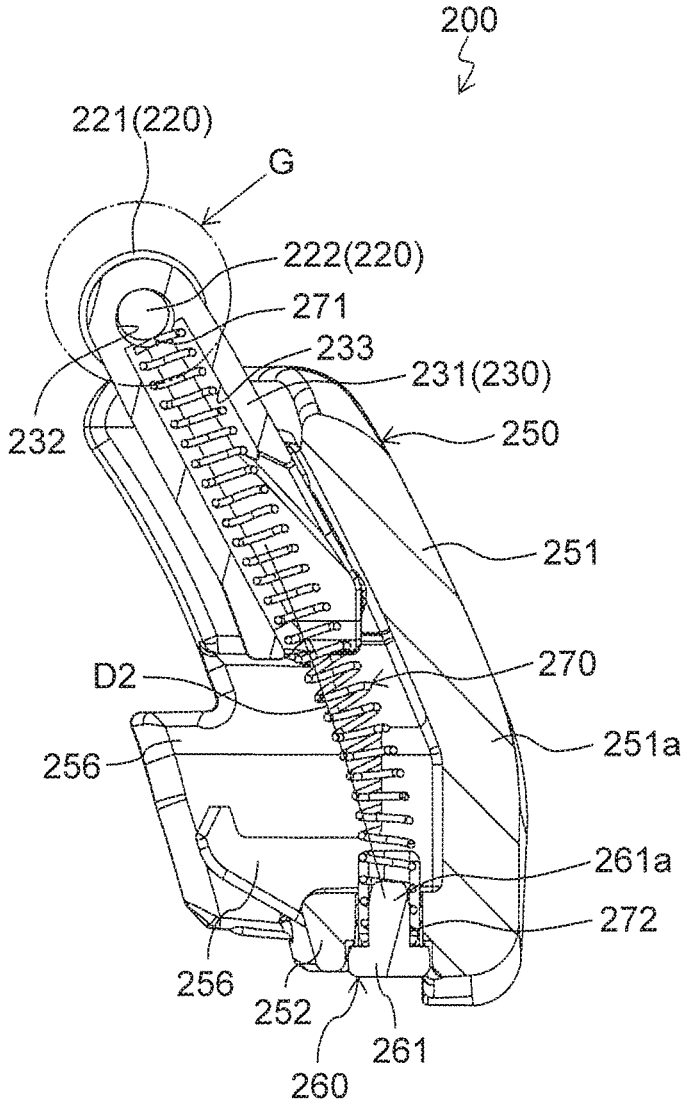
FIG. 17 is a sectional view taken along line 17-17 in FIG. 13.

On the other hand, lower ends 272 and 272 of coil springs (elastic bodies) 270 and 270 are supported by bottom wall 252 of rotator case 250 via spring receiving members 260 and 260 (refer to FIG. 17).

Specifically, as illustrated in FIG. 14, spring receiving member 260 includes spring receiving body 261 in which spring receiving projection 261*a* is formed at the center, and a pair of hooks 262 and 262 which is formed on both sides in lateral direction Y of spring receiving body 261.

Spring receiving member 260 is inserted from below into insertion hole 257 formed on bottom wall 252, and the pair of hooks 262 and 262 is caused to engage with bottom wall 252, thereby mounting, spring receiving member 260 on bottom wall 252.

In this case, spring receiving projection 261*a* is inserted into lower end 272 of coil spring (elastic body) 270. In this manner, coil spring (elastic body) 270 is supported by bottom wall 252 of rotator case 250 via spring receiving member 260.

Furthermore, in the present exemplary embodiment, guide projections 235 and 235 are respectively formed outside the pair of bearings 231 and 231 in lateral direction Y. Guide projections 235 and 235 are mounted on guide grooves 255 and 255 formed in rotator case 250 so as to be respectively slidable (refer to FIGS. 10A and 10B).

In the present exemplary embodiment, top walls 253*a* and 253*a* and front walls 253*b* and 253*b* are respectively formed on the pair of side walls 253 and 253 of rotator case 250, thereby forming guide grooves 255 and 255 which are open inward in lateral direction Y and downward in vertical direction Z.

In this way, guide projections 235 and 235 are mounted on guide grooves 255 and 255 so as to be respectively slidable. In this manner, while guide projections 235 and 235 are guided by guide grooves 255 and 255, rotator 210 (floater 211) floats to rotator case 250 (relatively move in vertical direction Z).

The present exemplary embodiment adopts a configuration which regulates rotator 210 (floater 211) floating to rotator case 250 in an upward direction by brining guide projections 235 and 235 into contact with top walls 253*a* and 253*a*.

Figure 13:
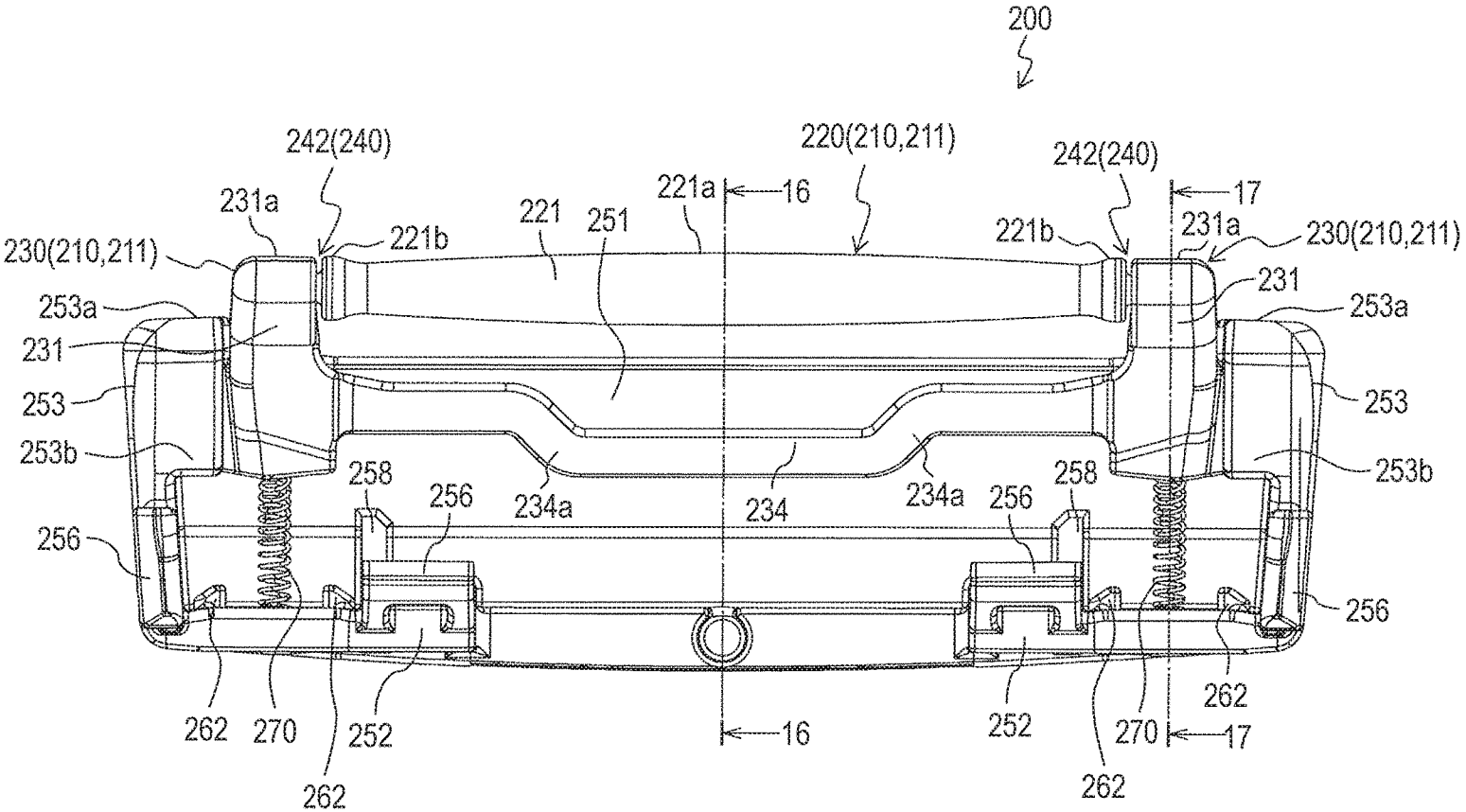
FIG. 13 is a view when the rotating body unit is viewed from inside according to the exemplary embodiment of the present disclosure.

On the other hand, rotator 210 (floater 211) floating to rotator case 250 in a downward direction is regulated by bringing connector 234 of supporter 230 into contact with regulation projections 258 and 258 formed on bottom wall 252 of rotator case 250 (refer to FIG. 13).

For example, rotating body unit 200 configured in this way can be assembled using the following method.

Connector 234 is elastically deformed from curves 234*a* and 234*a* as a base point. In this manner, the pair of bearings 231 and 231 is open outward in lateral direction Y.

In a state where the pair of bearings 231 and 231 is open outward in lateral direction Y, shafts 222 and 222 are inserted into bearing holes 232 and 232.

In this manner, rotating body 220 is mounted on supporter 230.

Next, guide projections 235 and 235 of supporter 230 on which rotating body 220 is mounted are inserted into guide grooves 255 and 255 of rotator case 250.

In this state, two coil springs (elastic bodies) 270 and 270 are inserted from below into insertion holes 257 and 257 formed on bottom wall 252, and are inserted into spring insertion holes 233 and 233 formed in bearings 231 and 231.

Thereafter, in a state where spring receiving projection 261*a* is inserted into lower end 272 of coil spring (elastic body) 270, spring receiving member 260 is inserted from below into insertion hole 257 formed on bottom wall 252, and the pair of hooks 262 and 262 is caused to engage with bottom wall 252.

In this way, rotating body unit 200 is formed in which rotator 210 (floater 211) is held by rotator case 250 so as to be floatable.

In this case, in a state of being contracted than a natural state (free state), coil spring (elastic body) 270 which supports floater 211 so as to be floatable to rotator case 250 is disposed between rotator 210 (floater 211) and rotator case 250.

Therefore, rotating body 220 is always biased toward supporter 230 (biased upward) by coil spring (elastic body) 270. That is, in a state where rotating body 220 is not in contact with skin S, rotating body 220 is supported by upper end 271 of coil spring (elastic body) 270 in a state where circumferential surface 222*a* of shaft 222 is in contact with inner surface 232*a* of bearing hole 232. In this manner, rotating body 220 is restrained from vibrating.

When rotating body 220 is brought into contact with skin S, in rotating body 220, shaft 222 moves downward relative to bearing 231 against a biasing force of coil spring (elastic body) 270. In this manner, contact between circumferential surface 222*a* of shaft 222 and inner surface 232*a* of bearing hole 232 is released. This configuration allows rotating body 220 to rotate.

In this way, the present exemplary embodiment adopts a configuration in which rotating body 220 is supported in supporter 230 by coil spring (elastic body) 270 which restrains rotating body 220 from vibrating in a state where rotating body 220 is not in contact with skin S while allowing rotating body 220 to rotate in a state where rotating body 220 is in contact with skin S.

In this case, it is preferable that a load applied to rotating body 220 by coil spring (elastic body) 270 is 1 time to 30 times the self-weight of rotating body 220.

If the load applied to rotating body 220 is smaller than the self-weight of rotating body 220, the rotation and the vibrations of rotating body 220 cannot be reduced by coil spring (elastic body) 270, thereby causing a possibility that abnormal sounds and vibrations may be generated. On the other hand, the load applied to rotating body 220 is greater than 30 times the self-weight of rotating body 220, an excessive frictional force is applied to rotating body 220. Consequently, rotating body 220 cannot be smoothly rotated.

In order to smoothly rotate rotating body 220 in a state where rotating body 220 is in contact with skin S, it is preferable to adopt a configuration in which contact between upper end 271 of coil spring (elastic body) 270 and circumferential surface 222*a* of shaft 222 is line contact or point contact. The present exemplary embodiment adopts a configuration in which upper end 271 of coil spring (elastic body) 270 comes into point contact with circumferential surface 222*a* of shaft 222 at one point or two points. In order to bring upper end 271 into line contact or point contact with circumferential surface 222*a* of shaft 222, it is preferable that the elastic body is formed using a hard material.

Figure 11:
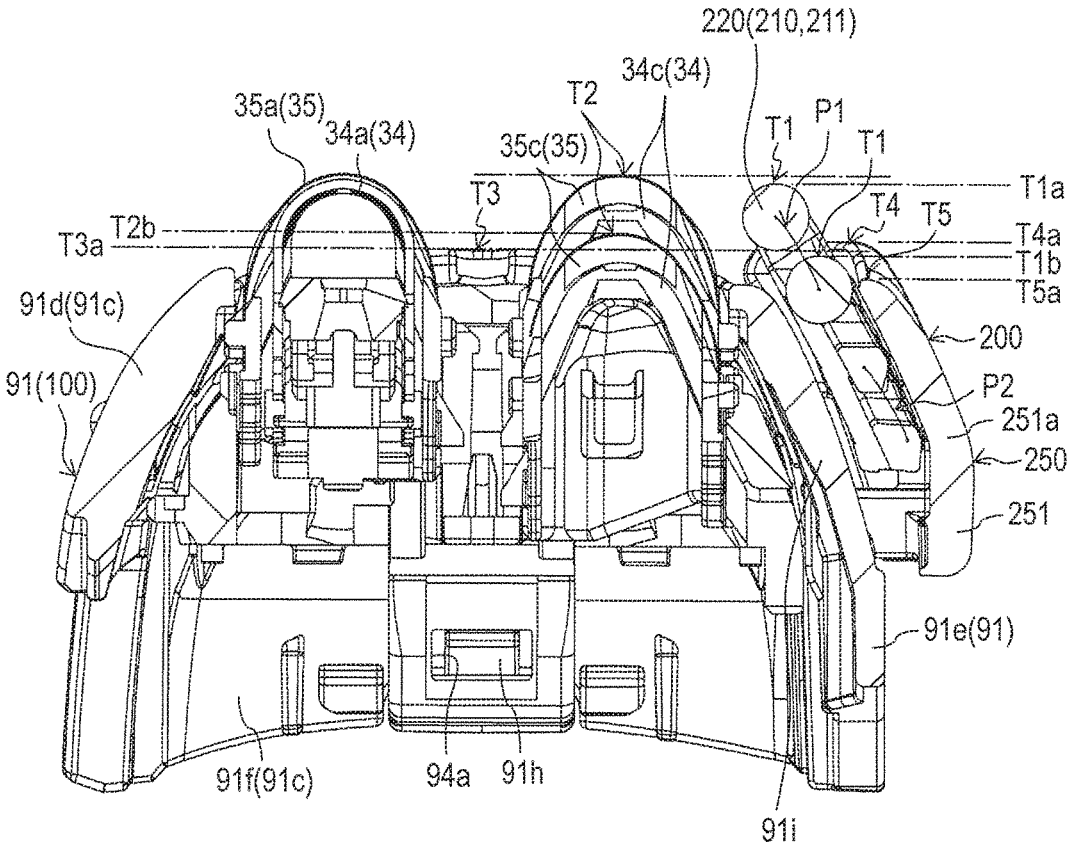
FIG. 11 is a view for describing a position relationship among an outer blade, an outer blade holding member, and the rotating body of the outer blade block according to the exemplary embodiment of the present disclosure.

Top T1 of rotator 210 (floater 211) is set so as to float between height T1*a* at a top dead center and height T1*b* at a bottom dead center (refer to FIG. 11).

While height T1*a* at the top dead center of top T1 is configured to be higher than height T4*a* of top (utmost top) T4 in both ends of rotator case 250, height T1*b* at the bottom dead center of top T1 is configured to be lower than height T4*a* of top (utmost top: upper end surface of top wall 253*a*) T4 in both ends of rotator case 250.

Furthermore, in the present exemplary embodiment, the center in lateral direction Y of rear wall 251 is formed so as to be recessed downward. Height T1*b* at the bottom dead center of top T1 is configured to be higher than height T5*a* of top T5 at the center of rotator case 250.

Rotating body unit 200 having this configuration is mounted on outer blade holding member 91 (shaver body 100).

Specifically, engagement hooks 256 respectively formed on bottom wall 252 and the pair of side walls 253 and 253 of rotator case 250 are caused to engage with engagement grooves 91*j* formed on rear wall 91*e* of outer blade holding member 91, thereby mounting rotating body unit 200 on outer blade holding member 91 (shaver body 100) from outside.

In this way, in the present exemplary embodiment, rotator 210 is integrally held by rotator case 250, and is disposed in outer blade holding member 91 (shaver body 100) via rotator case 250.

A configuration may be adopted in which rotating body unit 200 is mounted on outer blade holding member 91 (shaver body 100) so as to be detachable therefrom.

Rotating body unit 200 is mounted on rear wall 91*e* of outer blade holding member 91 from outside. In this manner, rotating body unit 200 is mounted on the outside of outer blade holding member 91 (shaver body 100) in a direction in which the plurality of outer blades 35 are arrayed parallel to each other (front-back direction X).

Therefore, rotating body 220 is disposed so as to extend in the reciprocating direction (lateral direction Y) of inner blade 34 disposed so as to be capable of linear reciprocating motion in lateral direction Y (refer to FIGS. 5 and 7).

In the present exemplary embodiment, in rotator 210, upper end surfaces 231*a* and 231*a* of the pair of bearings 231 and 231 and main body 221 of rotating body 220 serve as contact-available region R1 in which floater 211 can come into contact with skin S (refer to FIG. 5).

Width W1 in lateral direction (reciprocating direction of inner blade 34) Y in contact-available region R1 is configured to be equal to or wider than width W4 in lateral direction (reciprocating direction of inner blade 34) Y of second inner blade 34*c* (inner blade 34), and is configured to be equal to or wider than width W2 in lateral direction (reciprocating direction of inner blade 34) Y in reciprocating region R2 of second inner blade 34*c* (inner blade 34).

Furthermore, width W1 in lateral direction (reciprocating direction of inner blade 34) Y in contact-available region R1 is configured to be equal to or narrower than width (maximum width) W3 in lateral direction (reciprocating direction of inner blade 34) Y in outer blade holding member 91 (shaver body 100).

End portion R1*a* on one side in lateral direction (reciprocating direction of inner blade 34) Y in contact-available region R1 is configured to be positioned outside in lateral direction (reciprocating direction of inner blade 34) Y, compared to end portion R2*a* on one side in lateral direction (reciprocating direction of inner blade 34) Y in reciprocating region R2 of second inner blade 34*c* (inner blade 34). Furthermore, end portion R1*b* on the other side in lateral direction (reciprocating direction of inner blade 34) Y in contact-available region R1 is configured to be positioned outside in lateral direction (reciprocating direction of inner blade 34) Y, compared to end portion R2*b* on the other side in lateral direction (reciprocating direction of inner blade 34) Y in reciprocating region R2 of second inner blade 34*c* (inner blade 34).

That is, rotating body unit 200 is mounted on outer blade holding member 91 (shaver body 100) so that overall second inner blade 34*c* (inner blade 34) overlaps contact-available region R1 (upper end surfaces 231*a* and 231*a* and main body 221), in a state where second inner blade 34*c* (inner blade 34) is viewed in front-back direction X, even if second inner blade 34*c* (inner blade 34) performing linear reciprocating motion is located at any position.

In this way, an arrangement relationship between contact-available region R1 and inner blade 34 (in the present exemplary embodiment, second inner blade 34*c*) adjacent thereto in front-back direction X is specified. In this manner, the hair can be more comfortably and more effectively shaved.

In the present exemplary embodiment, as illustrated in FIG. 11, in a state where rotating body unit 200 is mounted on outer blade holding member 91 (shaver body 100), height T1*a* at the top dead center of top T1 of rotator 210 (floater 211) is configured to be lower than height T2*a* of top T2 at the top dead center of second net blade 35*c* (outer blade 35). In this case, it is preferable to adopt a configuration in which a difference between height T2*a* and height T1*a* is greater than 0 mm, and is equal to or smaller than 2 mm.

If a configuration is adopted in which the difference between height T2*a* and height T1*a* is equal to or greater than a blade thickness of outer blade 35, the top of inner blade 34 can be located at a position higher than height T1*a*. Accordingly, when the hair is cut by inner blade 34 and outer blade 35, it is possible to restrain a possibility that the hair may not be deeply shaved since rotator 210 (floater 211) interferes with the skin.

Furthermore, height T1*b* at the bottom dead center of top T1 is configured to be lower than height T2*b* of top T2 at the bottom dead center of second net blade 35*c* (outer blade 35).

Height T1*b* at the bottom dead center of top T1 is configured to be lower than height T3*a* of top T3 of outer blade holding member 91 (shaver body 100).

Height T2*b* at the bottom dead center of top T2 is configured to be higher than height T4*a* of top (utmost top: upper end surface of top wall 253*a*) T4 in both ends of rotator case 250, and is configured to be higher than height T3*a* of top T3 of outer blade holding member 91 (shaver body 100).

Figure 8B:
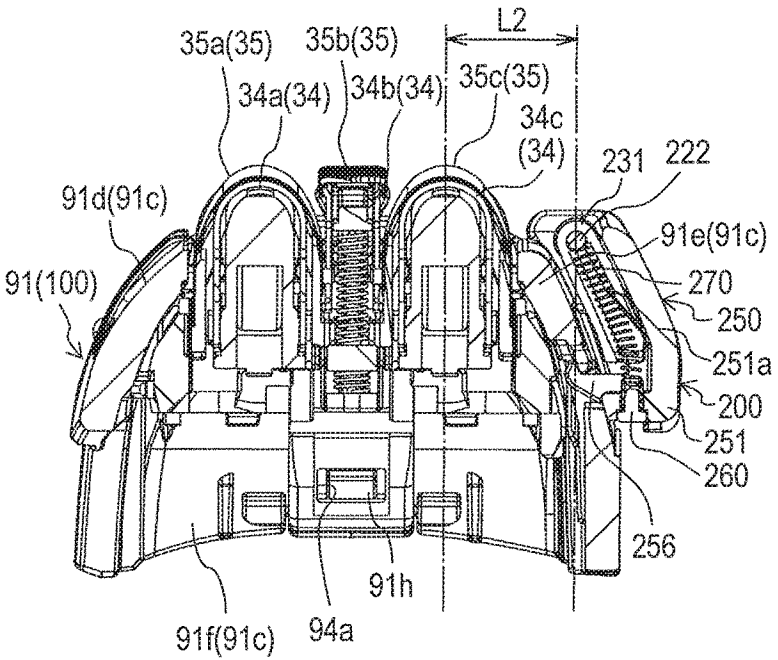
FIG. 8B is a sectional view taken along line 8B-8B in FIG. 7 in a state where the rotating body of the outer blade block is positioned at a bottom dead center according to the exemplary embodiment of the present disclosure.
Figure 8A:
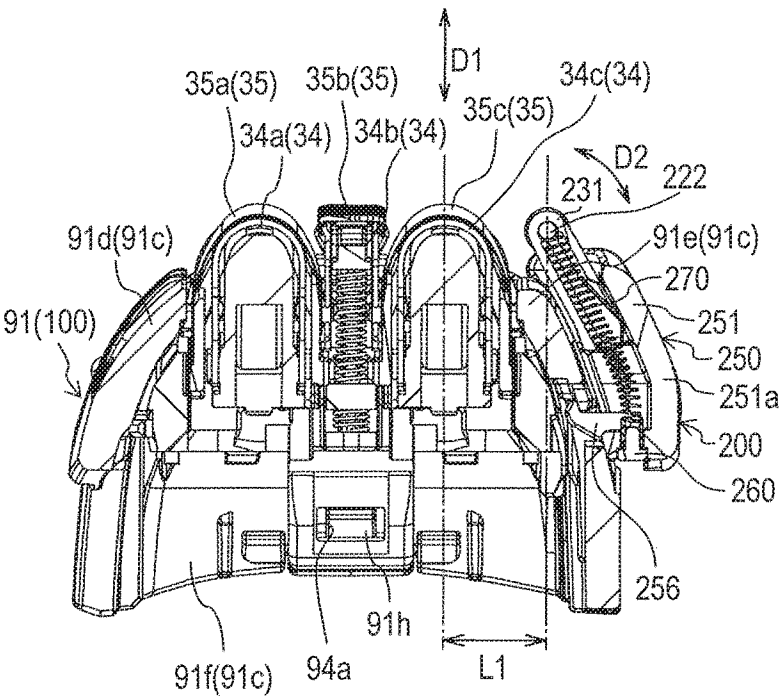
FIG. 8A is a sectional view taken along line 8A-8A in FIG. 7 in a state where a rotating body of the outer blade block is positioned at a top dead center according to the exemplary embodiment of the present disclosure.
Figure 9B:
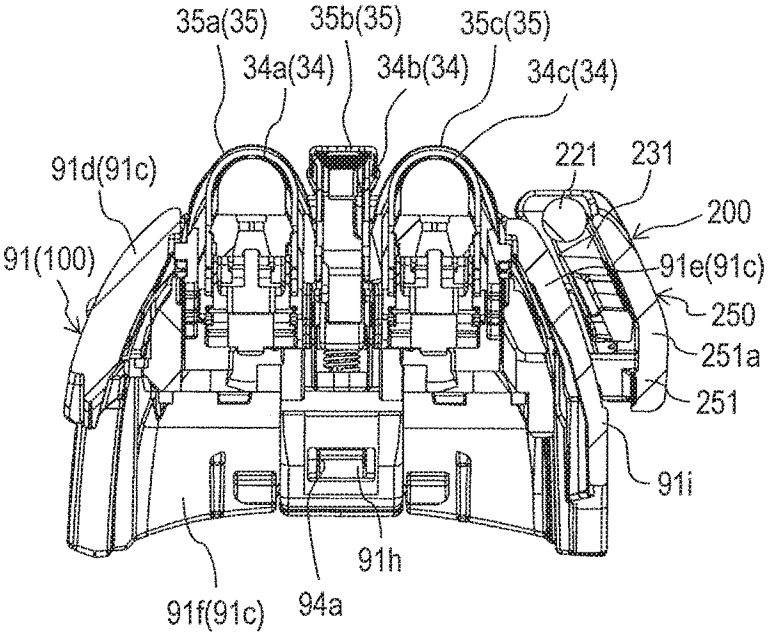
FIG. 9B is a sectional view taken along line 9B-9B in FIG. 7 in a state where the rotating body of the outer blade block is positioned at the bottom dead center according to the exemplary embodiment of the present disclosure.
Figure 9A:
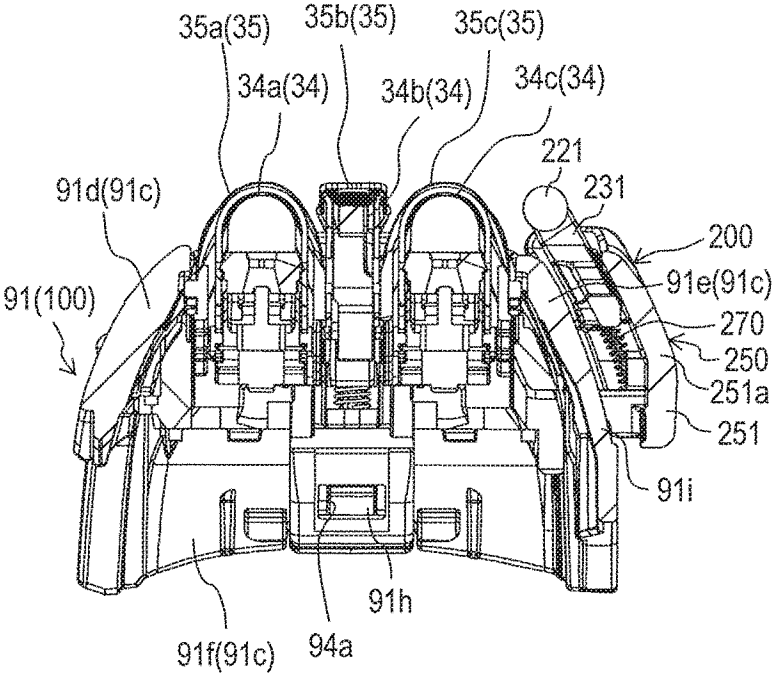
FIG. 9A is a sectional view taken along line 9A-9A in FIG. 7 in a state where the rotating body of the outer blade block is positioned at the top dead center according to the exemplary embodiment of the present disclosure.
Figure 10B:
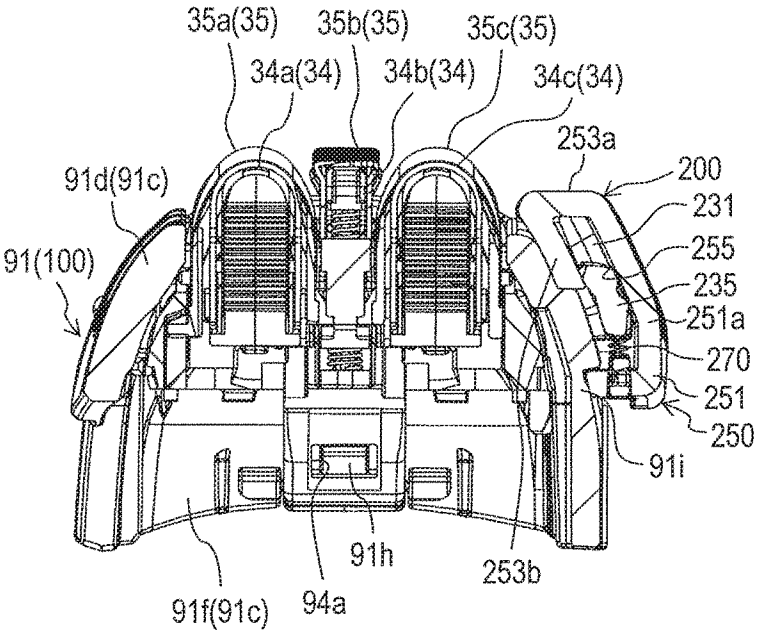
FIG. 10B is a sectional view taken along line 10B-10B in FIG. 7 in a state where the rotating body of the outer blade block is positioned at the bottom dead center according to the exemplary embodiment of the present disclosure.
Figure 10A:
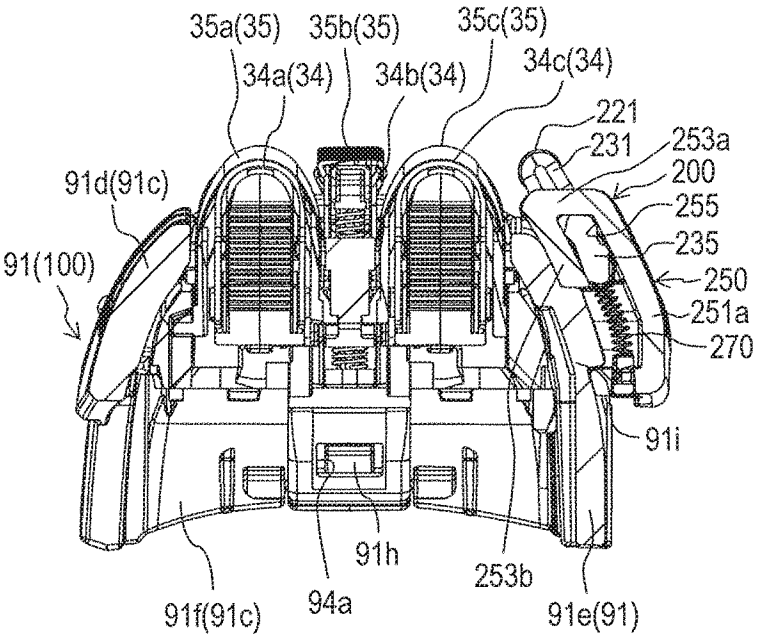
FIG. 10A is a sectional view taken along line 10A-10A in FIG. 7 in a state where the rotating body of the outer blade block is positioned at the top dead center according to the exemplary embodiment of the present disclosure.

Furthermore, the present exemplary embodiment adopts a configuration in which floating direction D2 of rotating body 220 (floater 211) intersects floating direction D1 (vertical direction Z) of outer blade 35 (refer to FIG. 8A).

Specifically, floating direction D2 of rotating body 220 (floater 211) is set so that rotating body 220 (floater 211) moves in a direction away from outer blade 35 (rearward in front-back direction X), when rotating body 220 (floater 211) floats downward. In the present exemplary embodiment, floating direction D2 is configured to be curved so as to project outward (rearward).

Specifically, curve 91*i* which projects outward (rearward) is formed on rear wall 91*e* of outer blade holding member 91 (shaver body 100), and curve 251*a* which is curved along curve 91*i* is formed on rear wall 251 of rotator case 250.

Furthermore, guide grooves 255 and 255 formed in rotator case 250 are also curved along curve 91*i*.

If rotating body 220 (floater 211) is caused to float, guide projection 235 moves along guide groove 255. A trajectory drawn in this case is displacement trajectory P2 of guide projection 235, and displacement trajectory P2 is curved along curve 91*i* (refer to FIG. 11).

As guide projection 235 is displaced, rotating body 220 (floater 211) is also displaced. A trajectory drawn by rotating body 220 (floater 211) is displacement trajectory P1 of rotating body 220. Similarly to displacement trajectory P2, displacement trajectory P1 of rotating body 220 is curved along curve 91*i*. A direction extending along displacement trajectory P1 of rotating body 220 is floating direction D2.

According to this configuration, if rotating body 220 (floater 211) is caused to float (move) from above to below, rotating body 220 (floater 211) is displaced so that a distance between rotating body 220 (floater 211) and second net blade 35*c* (outer blade 35) increases from L1 to L2 (refer to FIGS. 8A and 8B).

However, in the present exemplary embodiment, floating direction D2 is curved along curve 91*i*. Accordingly, as rotating body 220 (floater 211) further moves downward, a displacement amount of rotating body 220 (floater 211) displaced from second net blade 35*c* (outer blade 35) decreases.

In the present exemplary embodiment, rotating body 220 is supported by supporter 230 using the plurality of (two) coil springs (elastic bodies) 270 and 270 which are elastically deformable independently of each other.

Figure 23:
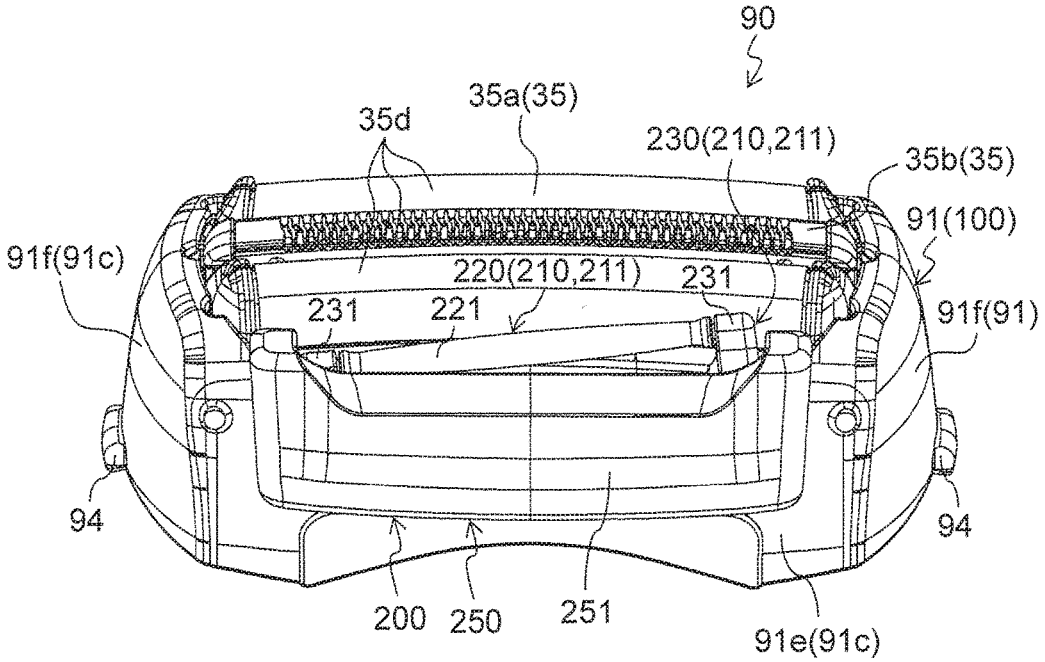
FIG. 23 is a perspective view illustrating the rotating body unit in a state where one end side of a rotator is moved downward according to the exemplary embodiment of the present disclosure.
Figure 24:
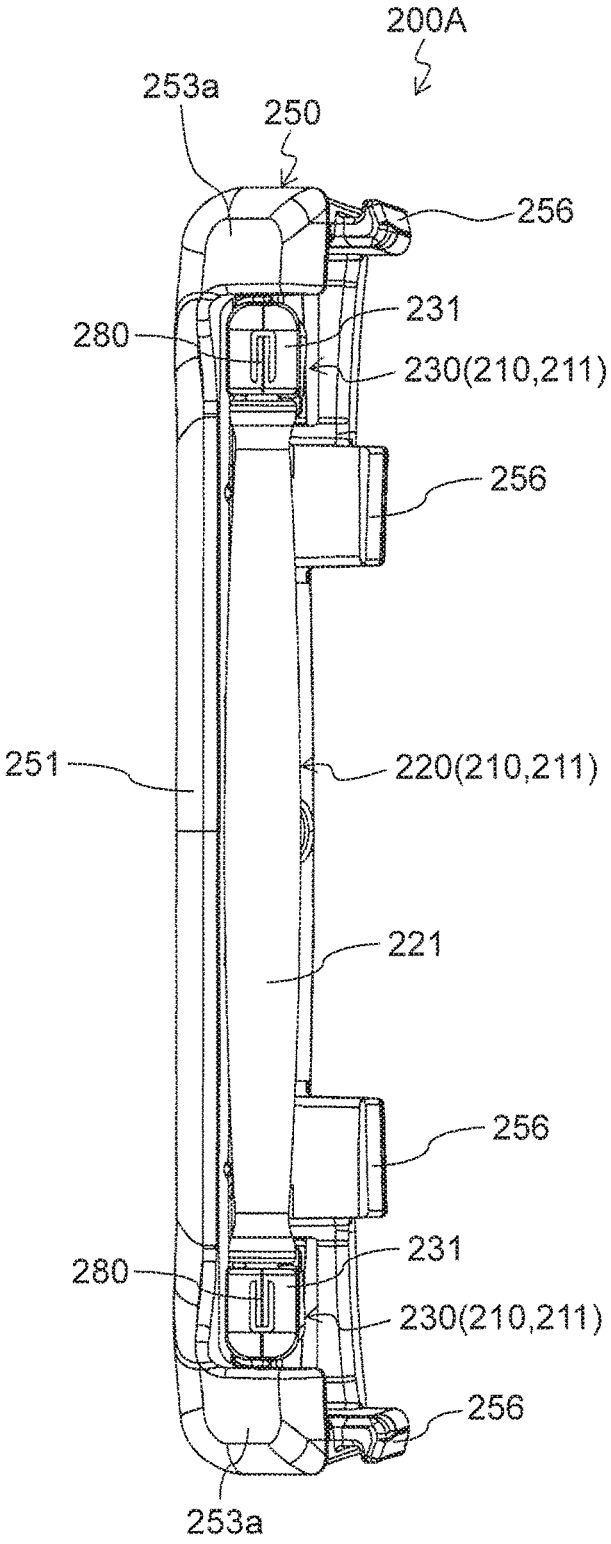
FIG. 24 is a plan view illustrating a configuration of a rotating body unit according to a first modification example of the exemplary embodiment of the present disclosure.
Figure 25:
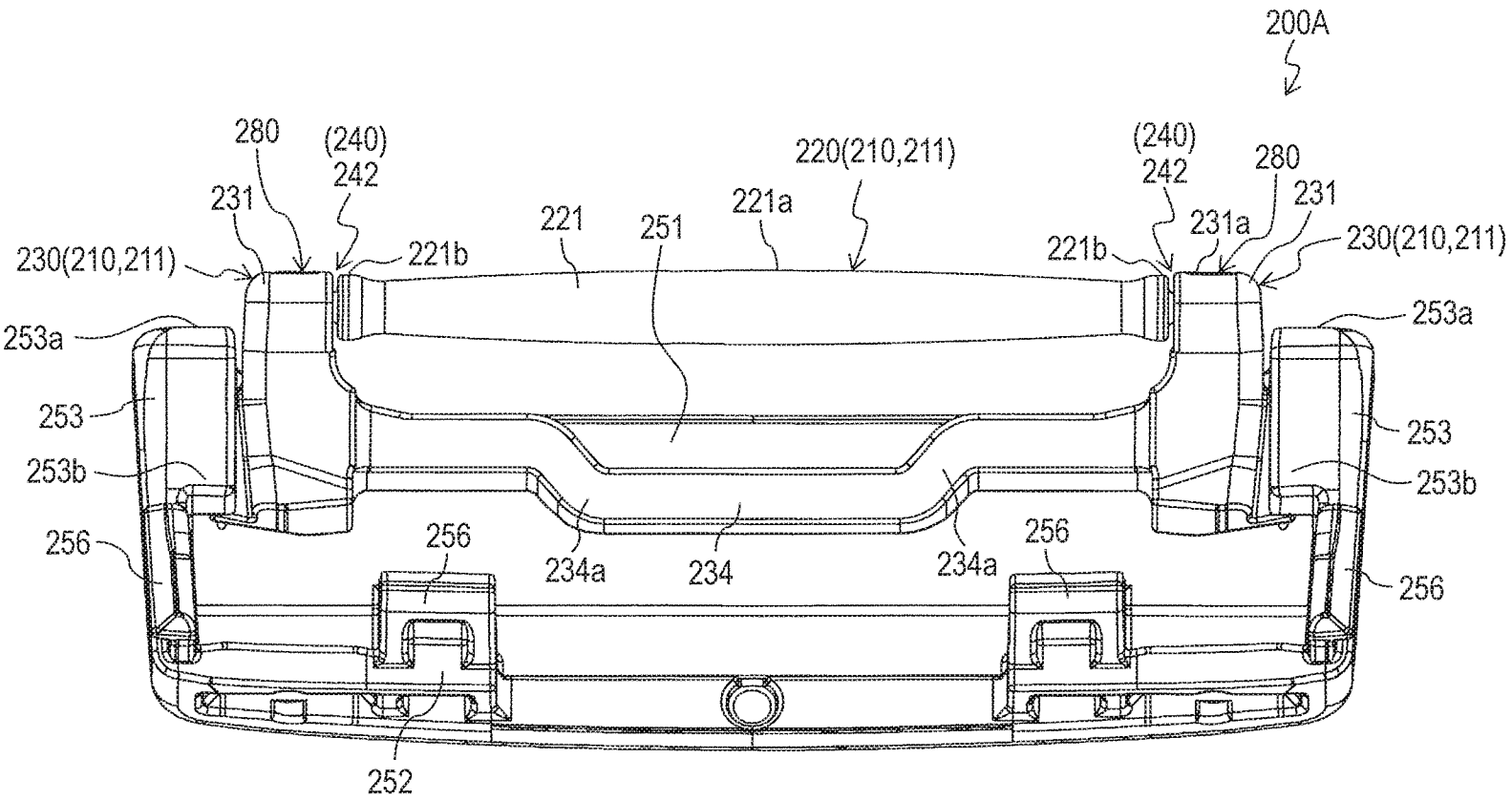
FIG. 25 is a view when a configuration of the rotating body unit is viewed from inside according to the first modification example of the exemplary embodiment of the present disclosure.
Figure 26:
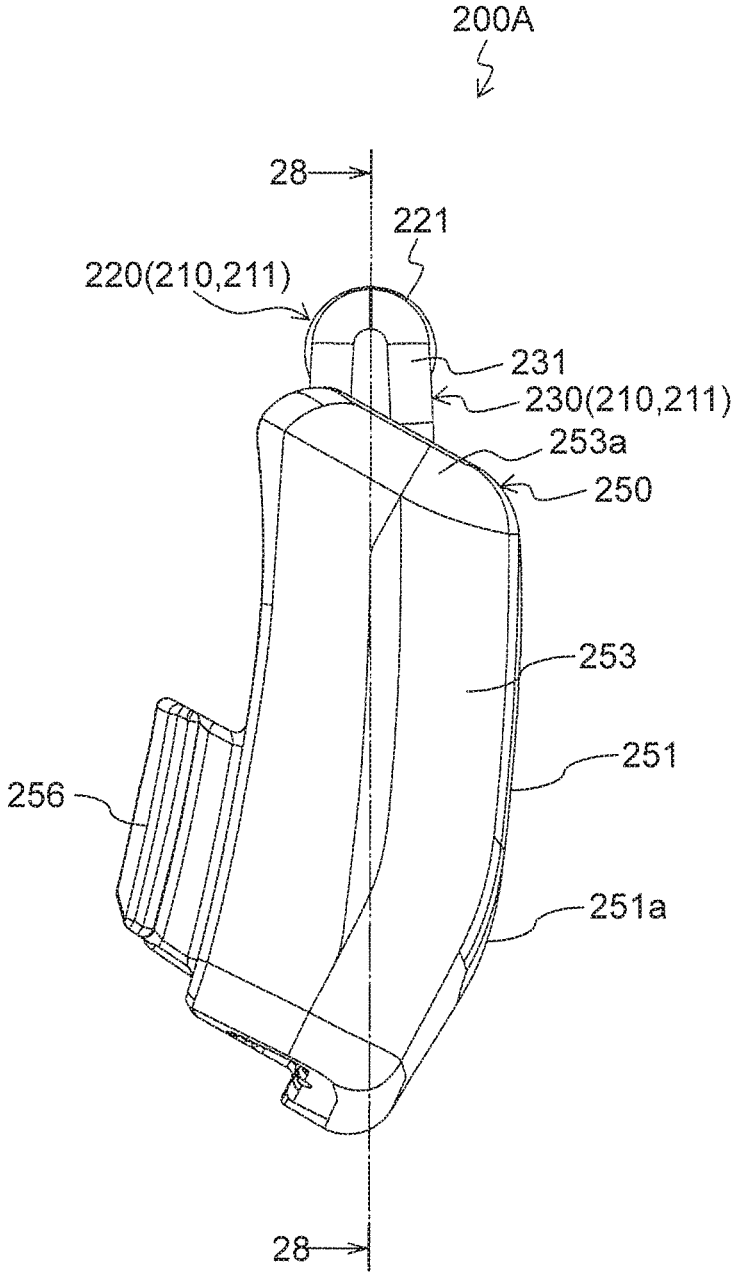
FIG. 26 is a side view illustrating a configuration of the rotating body unit according to the first modification example of the exemplary embodiment of the present disclosure.
Figure 27:
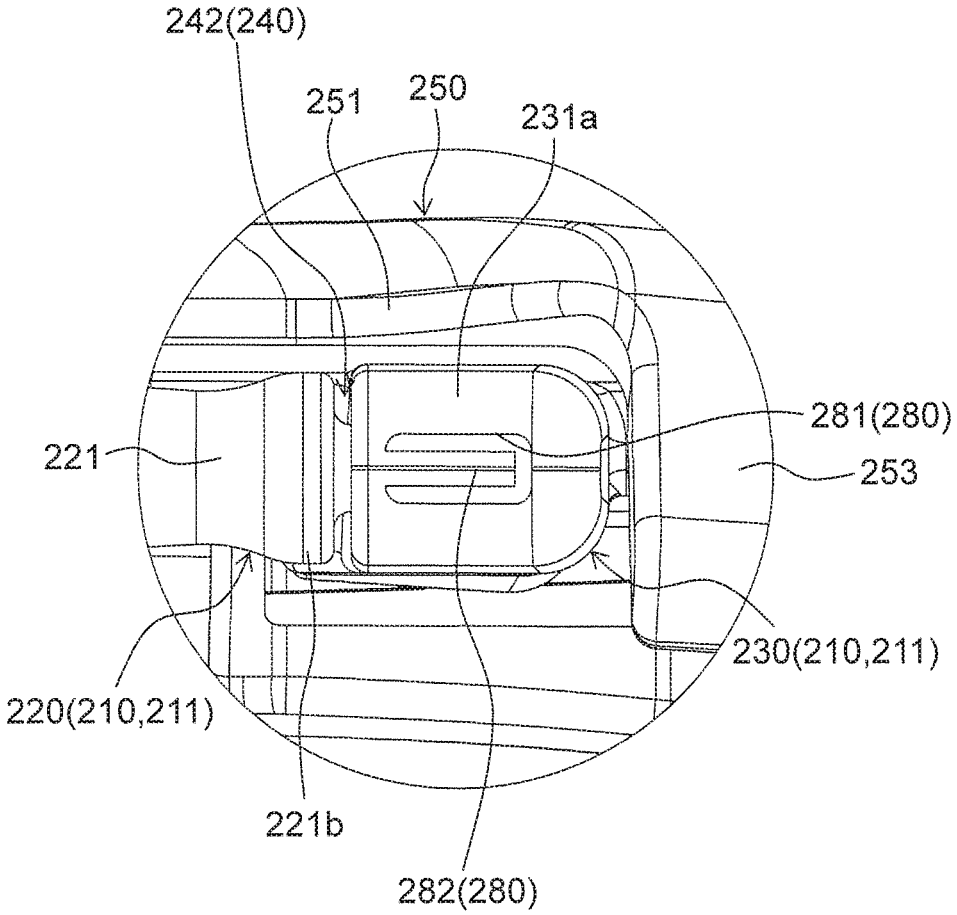
FIG. 27 is an enlarged plan view illustrating the vicinity of a shaft of a rotator in the rotating body unit according to the first modification example of the exemplary embodiment of the present disclosure.
Figure 28:
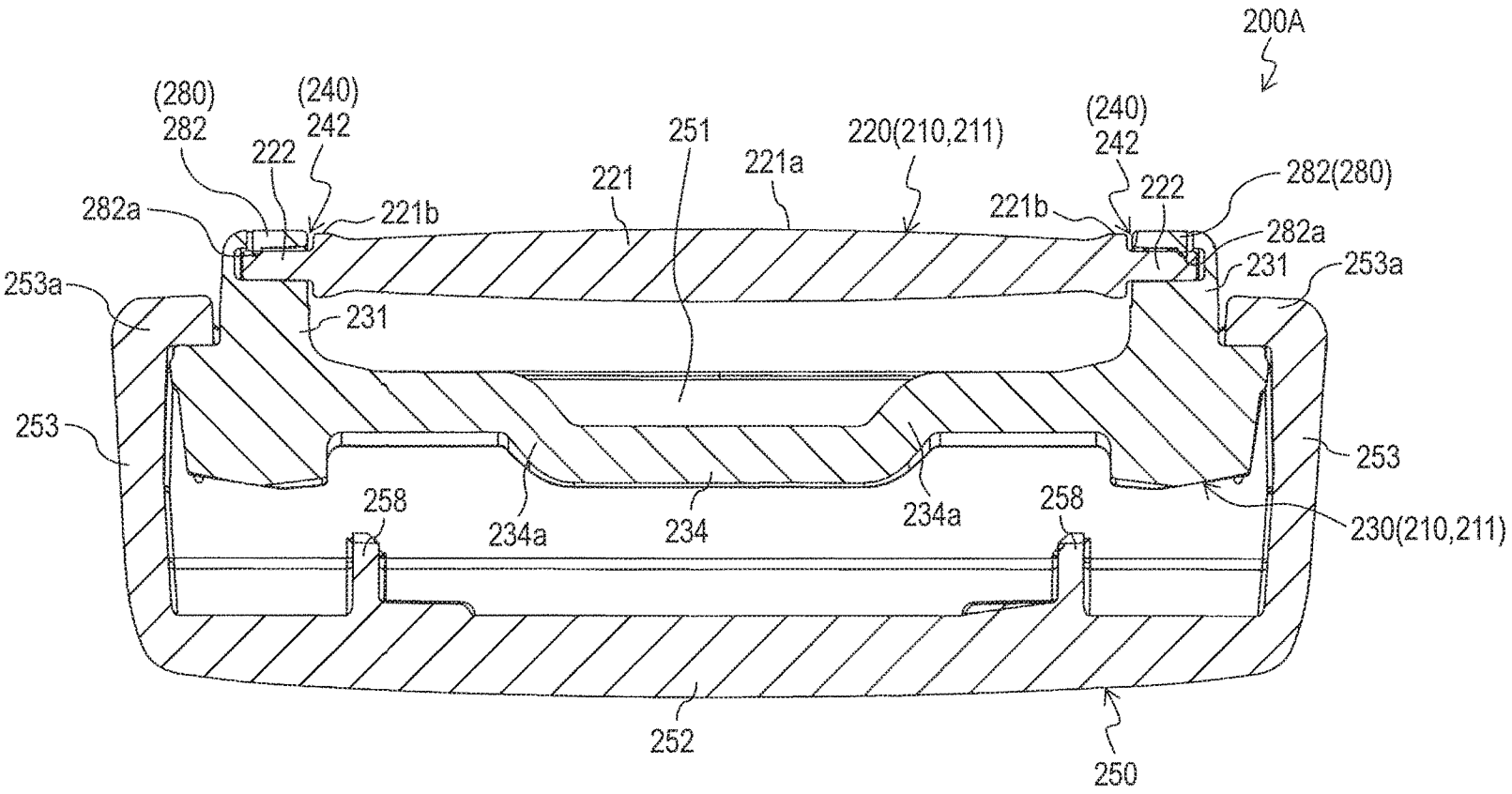
FIG. 28 is a sectional view taken along line 28-28 in FIG. 26.
Figure 29:
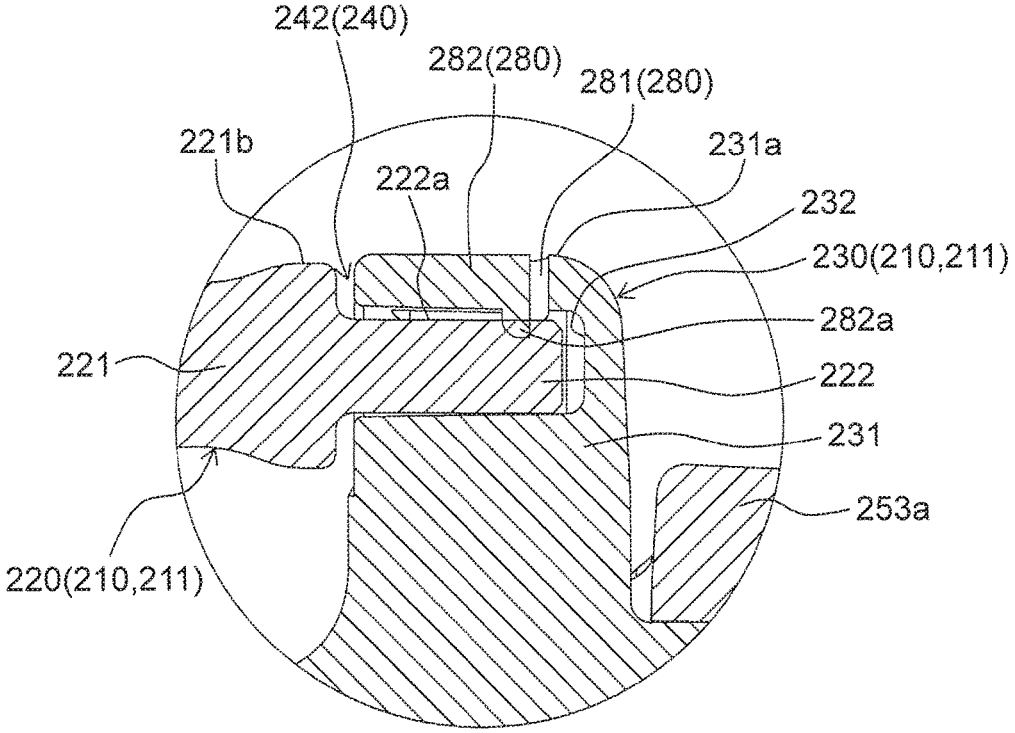
FIG. 29 is an enlarged view illustrating the vicinity of the shaft of the rotator in FIG. 28.
Figure 30:
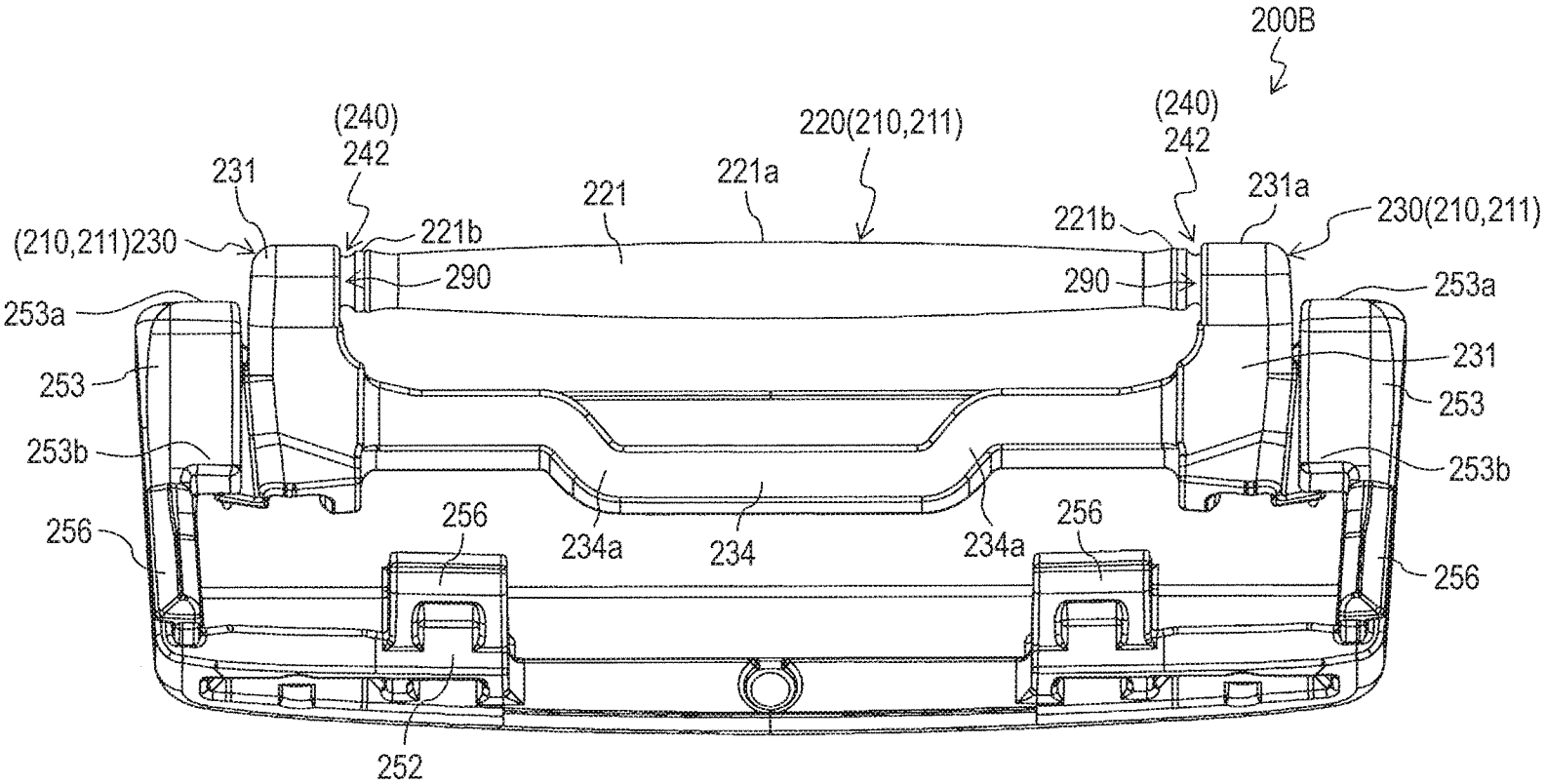
FIG. 30 is a view when a configuration of a rotating body unit is viewed from inside according to a second modification example of the exemplary embodiment of the present disclosure.
Figure 31:
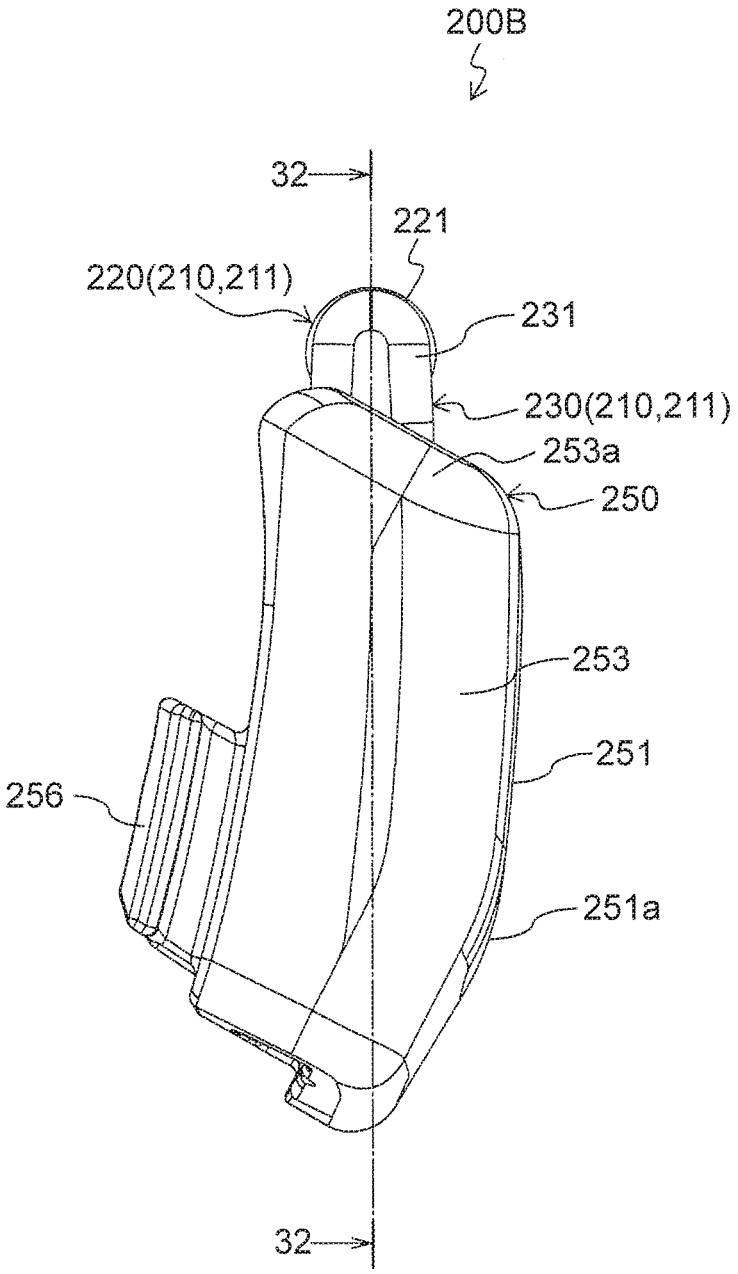
FIG. 31 is a side view illustrating a configuration of the rotating body unit according to the second modification example of the exemplary embodiment of the present disclosure.
Figure 32:
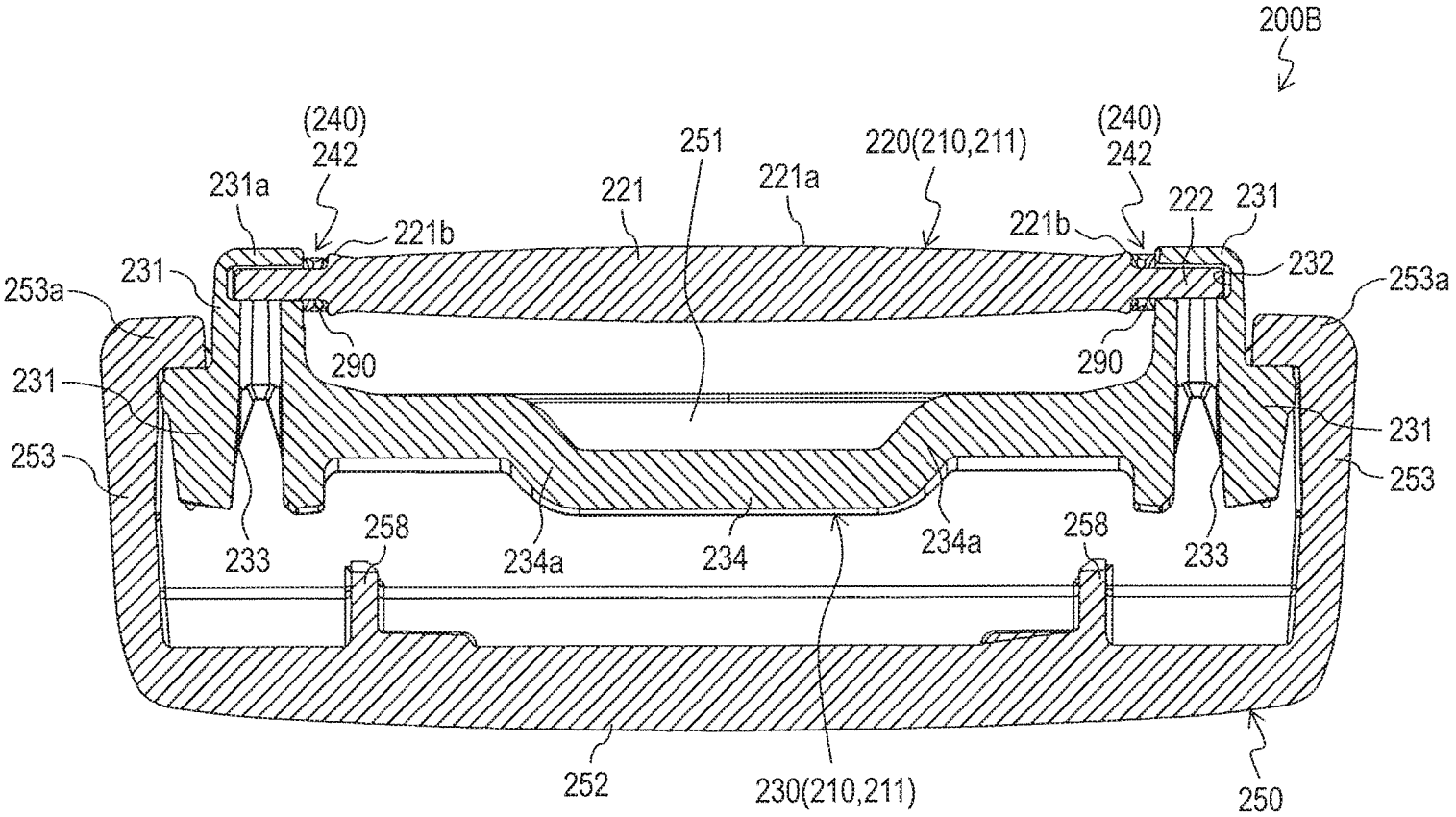
FIG. 32 is a sectional view taken along line 32-32 in FIG. 31.
Figure 33:
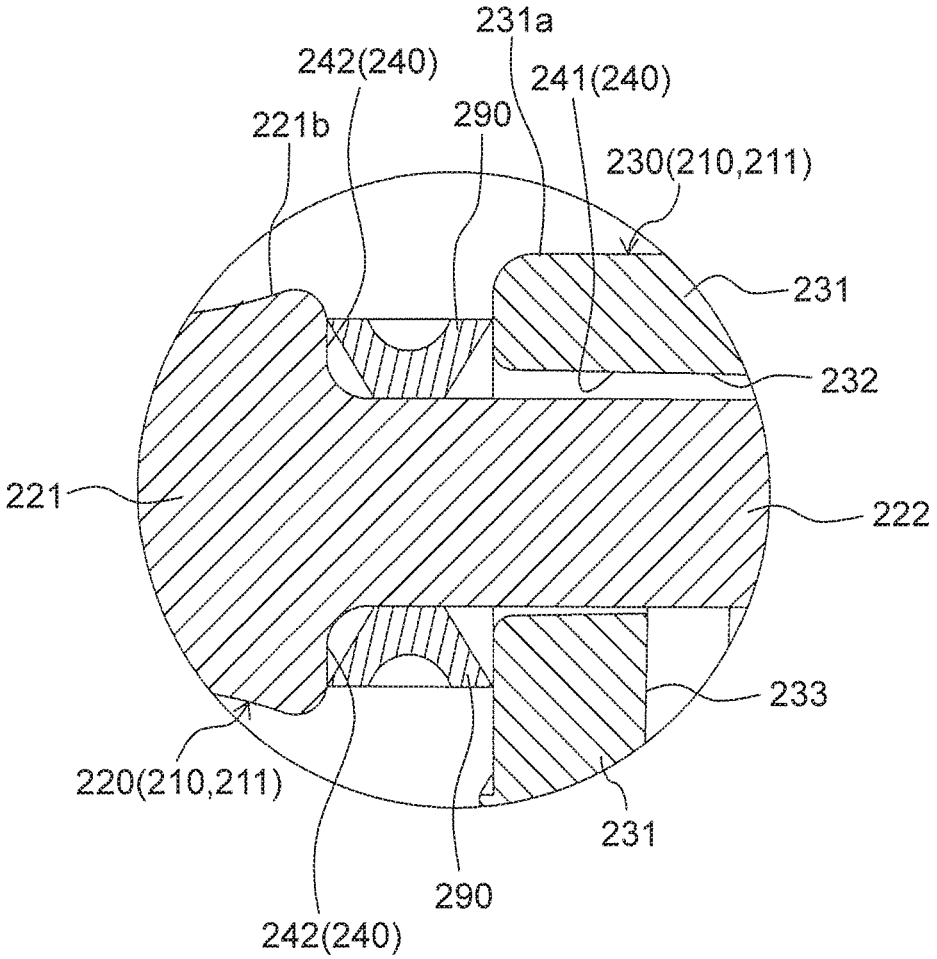
FIG. 33 is an enlarged view illustrating the vicinity of the shaft of the rotator in FIG. 32.

According to this configuration, rotator 210 (floater 211) can be displaced with a posture different from that of blade unit 33 (outer blade 35 and inner blade 34) (refer to FIG. 23).

Next, modification examples of the rotating body unit will be described.

As the rotating body unit, it is possible to use rotating body unit 200A illustrated in FIGS. 24 to 29, for example.

Basically, rotating body unit 200A has a configuration which is substantially the same as that of rotating body unit 200 described above. Rotating body unit 200A adopts a configuration in which rotator 210 formed in such a way that rotating body 220 is rotatably supported in supporter 230 is integrally held by rotator case 250.

Rotating body unit 200A is also configured to be supported in supporter 230 by elastic body 280 which restrains rotating body 220 from vibrating in a state where rotating body 220 is not in contact with skin S while allows rotating body 220 to rotate in a state where rotating body 220 is in contact with skin S.

Specifically, substantially U-shaped (including U-shape) slit 281 is formed in the pair of bearings 231 and 231, thereby forming elastic piece 282 which is elastically deformable.

In this way, in rotating body unit 200A, elastic body 280 is integrally formed in supporter 230.

According to this configuration, it is possible to reduce the number of components.

Projections 282*a* and 282*a* projecting toward shafts 222 and 222 are formed in elastic piece 282. Circumferential surfaces 222*a* and 222*a* of shafts 222 and 222 are biased downward by projections 282*a* and 282*a*, thereby bringing circumferential surface 222*a* of shaft 222 into contact with inner surface 232*a* of bearing hole 232.

As another example of the rotating body unit, it is also possible to use rotating body unit 200B illustrated in FIGS. 30 to 33, for example.

Basically, rotating body unit 200B also has a configuration which is substantially the same as that of rotating body unit 200 described above. Rotating body unit 200B adopts a configuration in which rotator 210 formed in such a way that rotating body 220 is rotatably supported in supporter 230 is integrally held by rotator case 250.

Rotating body unit 200B is also configured to be supported in supporter 230 by elastic body 290 which restrains rotating body 220 from vibrating in a state where rotating body 220 is not in contact with skin S while allows rotating body 220 to rotate in a state where rotating body 220 is in contact with skin S.

Specifically, a soft elastic body (elastic body 290) such as rubber or cushion is interposed in clearance 242 formed between main body 221 of rotating body 220 and bearings 231 and 231 of supporter 230. In this manner, rotating body unit 200B is configured to be capable of restraining rotating body 220 from vibrating in a state where rotating body 220 is not in contact with skin S while allows rotating body 220 to rotate in a state where rotating body 220 is in contact with skin S.

In this way, while strength of supporter 230 can be reliably ensured, it is possible to realize an elastic support structure of a space-saving and compact rotating body.

As described above, electric shaver 10 according to the present exemplary embodiment includes shaver body 100, outer blade 35 held by shaver body 100 in a state where contact surface (surface) 35*d* is exposed, and inner blade 34 disposed inside outer blade 35 so as to be movable relative to outer blade 35.

Furthermore, electric shaver 10 includes rotator 210 that has rotating body 220 mounted on shaver body 100 so as to be rotatable, and supporter 230 which supports rotating body 220 so as to be rotatable.

Rotating body 220 is supported in supporter 230 by the elastic body which restrains rotating body 220 from vibrating in a state where rotating body 220 is not in contact with skin S while allows rotating body 220 to rotate in a state where rotating body 220 is in contact with skin S. As the elastic body, for example, at least any one of coil spring 270, elastic body 280, and soft elastic body 290 is used.

According to this configuration, the elastic body restrains rotating body 220 from vibrating in a state where rotating body 220 is not in contact with skin S. Accordingly, it is possible to restrain an abnormal sound from being generated.

On the other hand, elastic body supports rotating body 220 so as to be rotatable in a state where rotating body 220 is in contact with skin S. Accordingly, when outer blade 35 is moved along skin S, rotating body 220 is rotated, thereby reducing a frictional force generated between outer blade 35 and skin S.

In this way, according to the present embodiment, it is possible to obtain electric shaver 10 which can restrain abnormal sounds and vibrations from being generated while more comfortably and more effectively cut the hair.

A configuration may be adopted in which the elastic body has coil spring 270 for biasing rotating body 220 toward supporter 230, and in which coil spring 270 supports rotating body 220 so as to be floatable.

In this way, coil spring 270 has a function to bias rotating body 220 toward supporter 230, and a function to cause rotating body 220 to float to shaver body 100. Accordingly, it is possible to reduce the number of components, and it is possible to simplify the configuration.

Since coil spring 270 is used, while the elastic body is allowed to have a small size, a load can be adjusted. Therefore, it is possible to obtain high reliability in contacting and high reliability in pressing.

A load applied to rotating body 220 by coil spring 270 may be 1 time to 30 times the self-weight of rotating body 220.

In this manner, a force of coil spring 270 to support rotating body 220 is ensured. It is possible to restrain a case where rotating body 220 becomes less likely to rotate due to an excessive frictional force applied to rotating body 220.

A configuration may be adopted in which outer blade 35 is supported by shaver body 100 so as to be floatable, and in which floating direction D2 of rotating body 220 intersects floating direction D1 of outer blade 35.

In this manner, a distance between rotating body 220 and outer blade 35 is changed since a displacement height is changed. When electric shaver 10 is used, the skin can be stretched or squeezed by rotating body 220 and outer blade 35. As a result, the hair can be more easily and deeply shaved.

A configuration may be adopted in which shaver body 100 has curve 91*i* which protrudes outward, and in which displacement trajectory P1 of rotating body 220 is curved along curve 91*i* of shaver body 100.

In this manner, shaver body 100 having rotator 210 can be miniaturized.

A configuration may be adopted in which rotator 210 is disposed outside shaver body 100.

In this way, rotator 210 is disposed outside shaver body 100 which is most likely to touch the skin. Accordingly, even in a case where shaver body 100 in a tilting state is used while touching skin S, a function of rotator 210 can be fulfilled. Therefore, it is possible to obtain more comfortable sensation in shaving.

A configuration may be adopted in which rotator 210 is integrally held by rotator case 250, and in which rotator 210 is disposed in shaver body 100 via rotator case 250.

In this way, rotator 210 is integrally held by rotator case 250. Therefore, while rigidity can be ensured, a size of shaver body 100 can be reduced.

A configuration may be adopted in which rotator case 250 is mounted on shaver body 100 so as to be detachable therefrom.

In this way, rotator 210 is used in a state where rotator 210 is not disposed in shaver body 100. In this manner, the hair can be more reliably deeply shaved. Rotator 210 is used in a state where rotator 210 is disposed in shaver body 100. In this manner, it is possible to reduce a frictional force generated between outer blade 35 and skin S. That is, a use state of electric shaver 10 can be diversified.

A plurality of types are prepared for the rotating body unit. Therefore, in accordance with use of the rotating body unit, electric shaver 10 can be properly used.

A configuration may be adopted in which inner blade 34 is disposed so as to be capable of linear reciprocating motion with respect to outer blade 35, and in which rotating body 220 is disposed so as to extend in the reciprocating direction (lateral direction Y) of inner blade 34. A configuration may be adopted in which rotator 210 has floater 211 which floats to shaver body 100.

A configuration may be adopted in which width W1 in the reciprocating direction of inner blade 34 in contact-available region R1 in which floater 211 can come into contact with skin S is equal to or wider than width W2 in the reciprocating direction of inner blade 34 in reciprocating region R2 of inner blade 34, and is equal to or narrower than width W3 in the reciprocating direction of inner blade 34 in shaver body 100.

Furthermore, end portion R1*a* on one side in the reciprocating direction of inner blade 34 in contact-available region R1 may be positioned outside in the reciprocating direction of inner blade 34, compared to end portion R2*a* on one side in the reciprocating direction of inner blade 34 in reciprocating region R2 of inner blade 34. End portion R1*b* on the other side in the reciprocating direction of inner blade 34 in contact-available region R1 may be positioned outside in the reciprocating direction of inner blade 34, compared to end portion R2*b* on the other side in the reciprocating direction of inner blade 34 in reciprocating region R2 of inner blade 34.

In this manner, while rotator 210 is restrained from increasing in size, rotator 210 can more reliably disperse a pressing force applied to the skin which is generated by the linear reciprocating motion of inner blade 34, and a frictional force applied to the skin.

Rotating body 220 may have a circular cross-sectional shape, and the diameter in the thickest portion (thickest portion 221*a*) of rotating body 220 may be 1.8 mm to 2.9 mm.

In this manner, when electric shaver 10 is used, while a function of rotator 210 can be fulfilled, discomfort caused by rotating body 220 coming into contact with skin S can be alleviated. Therefore, it is possible to obtain more comfortable sensation in shaving.

A configuration may be adopted in which rotator 210 has floater 211 which floats to shaver body 100. A configuration may be adopted in which height T1*a* of top T1 at the top dead center of floater 211 is lower than top T2 of outer blade 35 and is higher than top T3 of shaver body 100.

A configuration may be adopted in which height T1*b* of top T1 at the bottom dead center of floater 211 is lower than top T3 of shaver body 100.

In this way, height T1*a* of top T1 at the top dead center of floater 211 is lower than top T2 of outer blade 35. Accordingly, when the hair is shaved in irregular portions of the skin and portions below the nose, it is possible to restrain rotator 210 from interfering with such portions. As a result, electric shaver 10 can be restrained from having poor shaving performance. Height T1*a* of top T1 at the top dead center of floater 211 is higher than top T3 of shaver body 100. Accordingly, it is possible to restrain a function of rotator 210 from being hindered.

A configuration may be adopted in which height T1*b* of top T1 at the bottom dead center of floater 211 is lower than top T3 of shaver body 100. In this manner, when a user excessively presses outer blade 35 against skin S, a pressing force applied to skin S by rotator 210 can be alleviated. As a result, it is possible to obtain more comfortable sensation in shaving. Rotator 210 can be restrained from being damaged by impact when dropped, and thus long-term durability can be ensured.

In this way, each height of rotator 210, outer blade 35, and shaver body 100 is set to the above-described range. Accordingly, while electric shaver 10 can be restrained from having poor shaving performance, it is possible to obtain more comfortable sensation in shaving.

A configuration may be adopted in which top T6 of rotating body 220 has utmost top T7 whose height is highest, and in which utmost top T7 is higher than top T8 in both ends 221*b* of rotating body 220 and is higher than top T9 of supporter 230.

Top T8 in both ends 221*b* of rotating body 220 may be lower than top T9 of supporter 230.

In this way, in a front view (in a state where rotating body 220 is viewed in front-back direction X), the height of top T6 of rotating body 220 is caused to vary. Accordingly, a position of outer blade 35 and rotating body 220 can be set to an optimal position for any portion in lateral direction Y. Therefore, the hair can be shaved in a state where rotating body 220 is in closer contact with the skin.

Utmost top T7 is higher than top T9 of supporter 230. Accordingly, rotating body 220 can be brought into contact with skin S earlier than supporter 230. Therefore, smoother shaving comfort can be realized.

According to a configuration in which top T8 in both ends 221*b* of rotating body 220 is lower than top T9 of supporter 230, it is possible to restrain both ends 221*b* of rotating body 220 from coming into contact with skin S. Therefore, the hair can be more safely shaved.

In this way, each height of rotating body 220 and supporter 230 is set to the above-described range. Accordingly, while rotating body 220 can be more reliably brought into contact with skin S, discomfort caused by rotating body 220 coming into contact with skin S can be alleviated. Therefore, it is possible to obtain more safe and more comfortable sensation in shaving.

Rotating body 220 is supported in supporter 230 by the plurality of coil springs (elastic bodies) 270 which are elastically deformable independently of each other.

In this manner, rotating body 220 can be more reliably brought into contact with skin S having various irregular shapes. Therefore, it is possible to obtain more comfortable sensation in shaving.

Shaver body 100 may include drive body 110 which drives inner blade 34, and outer blade holding member 91 which supports outer blade 35 in a state where contact surface (surface) 35*d* is exposed.

Outer blade holding member 91 may be mounted on drive body 110 so as to be detachable therefrom, and rotator 210 may be disposed in outer blade holding member 91.

In this manner, maintenance work (cleaning or the like) for outer blade 35 disposed in outer blade holding member 91 and rotator 210 can be easily carried out. Outer blade holding member 91 of electric shaver 10 can be more easily replaced.

Outer blade holding member 91 according to the present exemplary embodiment holds outer blade 35 in a state where contact surface (surface) 35*d* is exposed, and is mounted on drive body 110 of shaver body 100 so as to be detachable therefrom. Rotator 210 is disposed in outer blade holding member 91.

In this way, outer blade holding member 91 which has rotator 210 and holds outer blade 35 is detached from drive body 110. Accordingly, maintenance work (cleaning or the like) for outer blade 35 disposed in outer blade holding member 91 and rotator 210 can be easily carried out. Outer blade holding member 91 can be more easily replaced.

Rotating body units 200, 220A, and 200B according to the present exemplary embodiment include rotator 210 which is disposed in electric shaver 10, and rotator case 250 which integrally holds rotator 210.

In this way, rotator 210 can be unitized. Accordingly, while rigidity can be ensured, a size of electric shaver 10 can be reduced.

Maintenance work (cleaning or the like) and replacement work for rotating body units 200, 200A, and 200B can be easily carried out. Rotator 210 can be easily disposed at a desired location of shaver body 100.

Hitherto, a preferred embodiment according to the present disclosure have been described. However, without being limited to the above-described embodiment, the present disclosure can be modified in various ways.

For example, in the above-described embodiment, electric shaver 10 including gripper 20 and head unit 30 has been described as an example. However, the present disclosure is also applicable to an electric shaver having no head unit.

Specifications (shape, size, layout and the like) of the main body, the rotator, and other detailed members can also be appropriately changed.

As described above, according to the present disclosure, it is possible to usefully obtain the electric shaver which can restrain an abnormal sound from being generated.

What is claimed is:

1. An electric shaver comprising:

a main body;

an outer blade that is held by the main body in a state where a surface of the outer blade is exposed;

an inner blade that is disposed inside the outer blade so as to be movable relative to the outer blade; and a rotator that has a rotating body disposed in the main body so as to extend in a moving direction of the inner blade, and a supporter disposed in the main body so as to rotatably support the rotating body, wherein the rotator has an elastic body which enables the rotating body to rotate in a state where the rotating body is in contact with a skin, and which restrains the rotating body from vibrating in a state where the rotating body is not in contact with the skin, wherein the electric shaver further comprises a rotator unit that has the rotator and a rotator case which holds the rotator, wherein the rotator unit is disposed in the main body via the rotator case, wherein the rotator is disposed on an outer surface of the main body, and wherein the rotator includes the supporter separately provided from the rotator case, the supporter connecting a pair of bearings and having holes through which springs pass through.

2. The electric shaver of claim 1, wherein the rotating body has a shaft in both ends of an extending direction of the rotating body, wherein the shaft is inserted into the pair of bearings, and wherein the springs support the rotating body so as to be floatable.

3. The electric shaver of claim 2, wherein a load applied to the rotating body by the springs is 1 time to 30 times the self-weight of the rotating body.

4. The electric shaver of claim 2, wherein the outer blade is supported by the main body so as to be floatable, and wherein a floating direction of the rotating body intersects a floating direction of the outer blade.

5. The electric shaver of claim 2, wherein the main body has a curve which protrudes outward, and wherein a displacement trajectory of the rotating body is curved along the curve of the main body.

6. The electric shaver of claim 1, wherein the rotator unit is mounted on the main body so as to be detachable from the main body.

7. The electric shaver of claim 1, wherein the inner blade is disposed so as to be capable of linear reciprocating motion, wherein the rotator extends in a reciprocating direction of the inner blade, and is disposed so as to be floatable to the main body, and wherein a length of the extending direction of the rotator is greater than a reciprocating range of the inner blade.

8. The electric shaver of claim 1, wherein the rotating body has a circular cross-sectional shape, and a diameter in a thickest portion of the rotating body is at least 1.8 mm and at most 2.9 mm.

9. The electric shaver of claim 1, wherein the rotator is disposed so as to be floatable to the main body, wherein a height of a top at a top dead center of the rotator becomes lower than a height of a top of the outer blade, and becomes higher than a height of a top of the main body, and wherein the height of the top at a bottom dead center of the rotator becomes lower than the height of the top of the main body.

10. The electric shaver of claim 1, wherein the top of the rotating body has an utmost top whose height becomes highest, and wherein the utmost top becomes higher than the top in both ends of the rotating body, and becomes higher than the top of the supporter.

11. The electric shaver of claim 1, wherein the rotating body is supported by a plurality of the elastic bodies which are elastically deformable independently of each other.

12. The electric shaver of claim 1, wherein the main body has a drive body which drives the inner blade, and an outer blade holding member which supports the outer blade in a state where the surface of the outer blade is exposed, wherein the outer blade holding member is mounted on the drive body so as to be detachable from the drive body, and wherein the rotator unit is disposed in the outer blade holding member.

* * * * *